US012584644B2

(12) United States Patent
Jo et al.

(10) Patent No.: US 12,584,644 B2
(45) Date of Patent: Mar. 24, 2026

(54) AIR PURIFIER

(71) Applicant: SAMSUNG ELECTRONICS CO., LTD., Suwon-si (KR)

(72) Inventors: Younglae Jo, Suwon-si (KR); Hyungmo Koo, Suwon-si (KR); Youngchal Park, Suwon-si (KR); Youngtae Song, Suwon-si (KR); Jaehyoung Sim, Suwon-si (KR); Kyeongae Lee, Suwon-si (KR); Eomji Jang, Suwon-si (KR); Sungjune Cho, Suwon-si (KR); Taesung Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 400 days.

(21) Appl. No.: 18/097,854

(22) Filed: Jan. 17, 2023

(65) Prior Publication Data

US 2023/0151982 A1 May 18, 2023

Related U.S. Application Data

(63) Continuation of application No. PCT/KR2021/007883, filed on Jun. 23, 2021.

(30) Foreign Application Priority Data

Aug. 14, 2020 (KR) ..... 10-2020-0102735

(51) Int. Cl.
*F24F 8/108* (2021.01)
*F24F 11/52* (2018.01)
*F24F 13/14* (2006.01)

(52) U.S. Cl.
CPC ..... *F24F 8/108* (2021.01); *F24F 11/52* (2018.01); *F24F 13/14* (2013.01); *F24F 2221/14* (2013.01)

(58) Field of Classification Search
CPC .. F24F 11/52; F24F 13/14; F24F 8/108; F24F 2221/14
(Continued)

(56) References Cited

U.S. PATENT DOCUMENTS 5,958,112 A * 9/1999 Nojima ..... F24F 1/0071 96/97
7,591,867 B2 * 9/2009 Choi ..... F24F 8/158 454/246
(Continued)

FOREIGN PATENT DOCUMENTS

CN 1410719 A 4/2003
CN 101225981 A 7/2008
(Continued)

OTHER PUBLICATIONS

International Search Report, PCT/ISA/210, dated Oct. 13, 2021, in PCT Application No. PCT/KR2021/007883.
(Continued)

*Primary Examiner* — Avinash A Savani
*Assistant Examiner* — Dana K Tighe
(74) *Attorney, Agent, or Firm* — STAAS & HALSEY LLP

(57) ABSTRACT

A ceiling type air purifier including a housing having an opening on a lower side; a filter on one side of the opening and fixed to the housing; a fan configured to circulate air having passed through the filter; a convergent space formed in the housing and configured to receive air circulated by the fan; and a discharge assembly including a discharge plate formed to match a lower portion of the convergent space, a discharge blade rotatably coupled with the discharge plate so as to be rotatable to control a moving direction of air discharged from the convergent space, and a rotation shaft at one end of the discharge assembly. The discharge assembly
(Continued)

may be coupled with the housing to be rotatable on the rotation shaft so as to rotate to open the convergent space to allow access to the convergent space, and to rotate to close the convergent space.

17 Claims, 20 Drawing Sheets

(58) Field of Classification Search
USPC ..... 454/187
See application file for complete search history.

(56) References Cited

U.S. PATENT DOCUMENTS

| | | | | |
|---|---|---|---|---|
| 8,252,078 | B2 * | 8/2012 | Mun | F24F 8/90 55/296 |
| 9,746,231 | B2 | 8/2017 | Moon et al. | |
| 10,203,150 | B2 | 2/2019 | Jeong et al. | |
| 10,309,683 | B2 | 6/2019 | Choi et al. | |
| 10,724,760 | B2 | 7/2020 | Iwatsuki et al. | |
| 11,028,223 | B2 * | 6/2021 | Niemiec | F21V 29/67 |
| 11,754,313 | B2 | 9/2023 | Tomohito et al. | |
| 2001/0049927 | A1 * | 12/2001 | Toepel | B01D 46/88 55/385.2 |
| 2007/0066215 | A1 * | 3/2007 | Song | F24F 1/035 62/317 |
| 2011/0048057 | A1 * | 3/2011 | Lee | F24F 13/28 29/428 |
| 2015/0129179 | A1 * | 5/2015 | Moon | F24F 1/0063 361/752 |
| 2016/0303271 | A1 * | 10/2016 | Livchak | F24F 1/01 |
| 2020/0263882 | A1 * | 8/2020 | Kim | F24F 1/0014 |
| 2021/0332996 | A1 * | 10/2021 | Bender | F24F 8/108 |

FOREIGN PATENT DOCUMENTS

| | | |
|---|---|---|
| EP | 2 251 616 A1 | 11/2010 |
| EP | 3 904 774 A1 | 11/2021 |
| JP | 11-94295 | 4/1999 |
| JP | 6576470 | 9/2019 |
| KR | 2000-0056585 | 9/2000 |
| KR | 10-0337288 | 5/2002 |
| KR | 10-2004-0107732 | 12/2004 |
| KR | 10-2005-0104730 | 11/2005 |
| KR | 10-2008-0038612 | 5/2008 |
| KR | 10-0865091 | 10/2008 |
| KR | 10-0909243 | 7/2009 |
| KR | 10-1140714 | 5/2012 |
| KR | 10-2015-0055204 | 5/2015 |
| KR | 10-2016-0101848 | 8/2016 |
| KR | 10-2017-0019289 | 2/2017 |
| KR | 10-2018-0026953 | 3/2018 |
| KR | 10-1833479 | 4/2018 |
| KR | 10-2018-0112447 | 10/2018 |
| KR | 10-2019-0026325 | 3/2019 |
| KR | 10-2043379 | 11/2019 |
| KR | 10-2020-0082058 | 7/2020 |

OTHER PUBLICATIONS

Written Opinion, PCT/ISA/237, dated Oct. 13, 2021, in PCT Application No. PCT/KR2021/007883.
Korean Office Action dated Dec. 9, 2024 for Korean Application No. 10-2020-0102735.
Extended European Search Report dated Oct. 30. 2023 in European Patent Application No. 21856049.8.
Chinese Office Action dated Jan. 1, 2026 for Chinese Application No. CN 202180055438.8.

* cited by examiner

AIR PURIFIER

CROSS-REFERENCE TO RELATED APPLICATIONS

This application is a continuation application under 35 U.S.C. § 111(a) of international Application No. PCT/KR2021/007883, filed on Jun. 23, 2021, which claims priority to Korean Patent Application No. 10-2020-0102735, filed on Aug. 14, 2020, the disclosures of which are incorporated by reference herein in their entireties.

BACKGROUND

1. Field

The disclosure relates to an air purifier, and more particularly, to an air purifier having a structure in which accessibility to electronic components arranged in the air purifier is improved.

2. Description of the Related Art

An air purifier is a device used to remove contaminants in the air. The air purifier may remove germs, viruses, mold, fine dust, and chemicals which cause offensive odor in the air sucked in.

The air purifier may include a filter for purifying contaminated indoor air. The air sucked into the air purifier may be purified into clean air with the contaminants removed while passing through the filter, and the purified air may be discharged out of the air purifier.

The air purifier may include an electric room with many different electric components arranged therein for driving a pollution level sensor, a fan and a discharge blade.

The air purifier, a ceiling type air purifier in particular, may allow access to the electric room in the air purifier to fix the electric room by taking apart a grill defining the exterior of the air purifier and then various components such as a discharge assembly including the filter and the discharge blade.

SUMMARY

Aspects of embodiments of the disclosure will be set forth in part in the description which follows and, in part, will be apparent from the description, or may be learned by practice of the presented embodiments.

According to an embodiment of the disclosure, a ceiling type air purifier may include a housing having an opening on a lower side; a filter arranged on one side of the opening and fixed to the housing; a fan configured to circulate air having passed through the filter; a convergent space formed in the housing and configured to receive air circulated by the fan; and a discharge assembly including a discharge plate formed to match a lower portion of the convergent space, a discharge blade rotatably coupled with the discharge plate so as to be rotatable to control a moving direction of air discharged from the convergent space, and a rotation shaft arranged at one end of the discharge assembly. The discharge assembly may be coupled with the housing to be rotatable on the rotation shaft so as to rotate to open the convergent space to allow access to the convergent space, and to rotate to close the convergent space.

According to an embodiment of the disclosure, the ceiling type air purifier further includes an electric room arranged in the convergent space, and a plurality of electric components arranged in the electric room and configured to operate the ceiling type air purifier.

According to an embodiment of the disclosure, the ceiling type air purifier further includes an installation area for the filter; and a partition plate formed in the housing and separating the installation area and the fan from the convergent space.

According to an embodiment of the disclosure, the ceiling type air purifier further includes a flow path formed in the housing, wherein the flow path is configured so that the air circulated by the fan flows in the flow path from the fan, through the partition plate, and to the convergent space.

According to an embodiment of the disclosure, the flow path includes a flow path outlet configured to discharge the air flowing in the flow path to the convergent space, wherein the flow path outlet is arranged on at least one of a lower side and circumference of the electric room.

According to an embodiment of the disclosure, the discharge assembly is arranged under the flow path outlet.

According to an embodiment of the disclosure, the discharge assembly further includes a blade motor adjacent to the rotation shaft and fixed to the discharge plate, and configured to rotate the discharge blade.

According to an embodiment of the disclosure, the discharge plate includes a shaft projection arranged on the rotation shaft and formed on one side of the discharge plate, and the housing includes a settling groove in which the shaft projection is inserted so that the discharge assembly is rotatable.

According to an embodiment of the disclosure, the housing includes a body housing including the flow path and the partition plate; and an edge plate matching edges of the lower side of the body housing formed along the opening of the housing, wherein the settling groove is formed on one side of the edge plate.

According to an embodiment of the disclosure, the settling groove includes a guide plane on which the shaft projection is rotatable and slidable.

According to an embodiment of the disclosure, the guide plane is formed in a longitudinal direction of the edge plate on which the settling groove formed.

According to an embodiment of the disclosure, the guide plane includes a slope tilted toward a lower side of the ceiling type air purifier.

According to an embodiment of the disclosure, the discharge plate includes a buffer including a curved plane on a top of a side of the discharge plate opposite to the blade motor.

According to an embodiment of the disclosure, the ceiling type air purifier further includes a grill covering the filter and the discharge assembly, the grill being detachably coupled with the lower side of the housing.

According to an embodiment of the disclosure, the grill includes a plurality of holes formed on the grill, and the discharge assembly further includes a display configured to display an operation status of the ceiling type air purifier through the plurality of holes formed on the grill.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
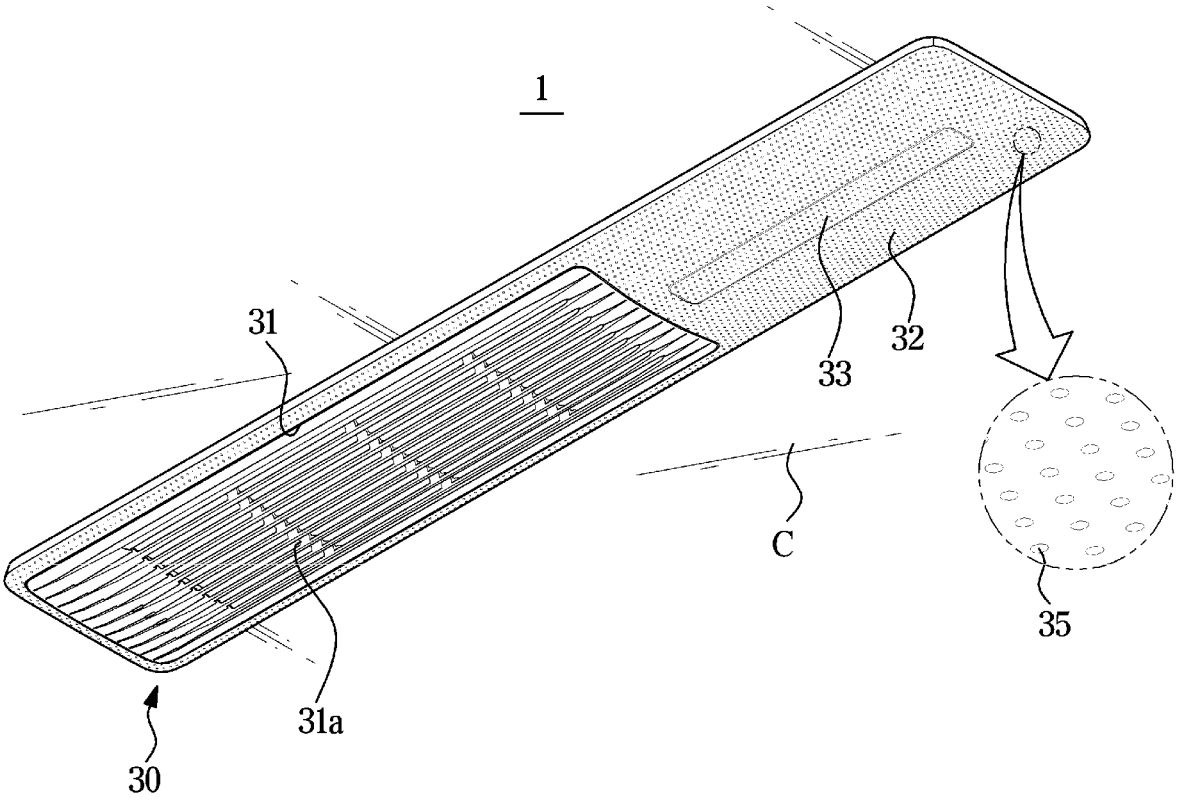
FIG. 1 illustrates an air purifier, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "forward or front", "rearward or behind", "left", and "right" as herein used are defined with respect to the drawings, but the terms may not restrict the shapes and position of the respective components.

Embodiments of the disclosure provide a ceiling type air purifier with enhanced accessibility to electric components arranged in the air purifier.

Embodiments of the disclosure also provide a ceiling type air purifier with an enhanced layout of an electric room in the air purifier, which leads to a reduction in overall volume.

According embodiments of the disclosure, a ceiling type air purifier may include a housing having an opening on a lower side; a filtration space formed in the housing and having a filter and a fan arranged therein; a convergent space formed in the housing and in which air moved by the fan converges; an electric room arranged in the convergent space; a partition plate separating the filtration space from the convergent space; and a discharge assembly including a discharge blade, opening or closing the convergent space, and rotationally coupled with the housing, the discharge assembly exposing the electric room in response to opening of the convergent space.

A flow path formed in the housing and in which air having passed the partition plate is moved from the filtration space to the convergent space may be further included.

The flow path may include a flow path outlet through which to discharge air from the flow path to the convergent space, and the flow path outlet may be arranged on at least one of the lower side or circumference of the electric room.

The discharge assembly may further include a shaft projection formed on one side of the discharge assembly, and the housing may further include a settling groove to which the shaft projection is inserted to allow the discharge assembly to be rotated against the housing.

The settling groove may include a guide plane for the shaft projection to rotate or slide.

According to embodiments of the disclosure, an air purifier may have an electric room installed in a convergent space in which filtered air is received, eliminating the need for an extra space for installing the electric room, thereby reducing the overall volume of the air purifier.

According to embodiments of the disclosure, an air purifier may allow access to internal space of the air purifier with a discharge assembly coupled to the housing even when opened by a rotation operation without need to completely take apart the discharge assembly.

According to embodiments of the disclosure, an air purifier may have a discharge assembly arranged under the convergent space and an electric room arranged in the convergent space, allowing easy access to the electric room when opened by a rotation operation of the discharge assembly.

According to the disclosure, an air purifier may effectively open or close the convergent space with a shaft projection of the discharge assembly that is able to rotate or slide.

Reference will now be made in detail to embodiments of the disclosure, which are illustrated in the accompanying drawings.

Figure 2:
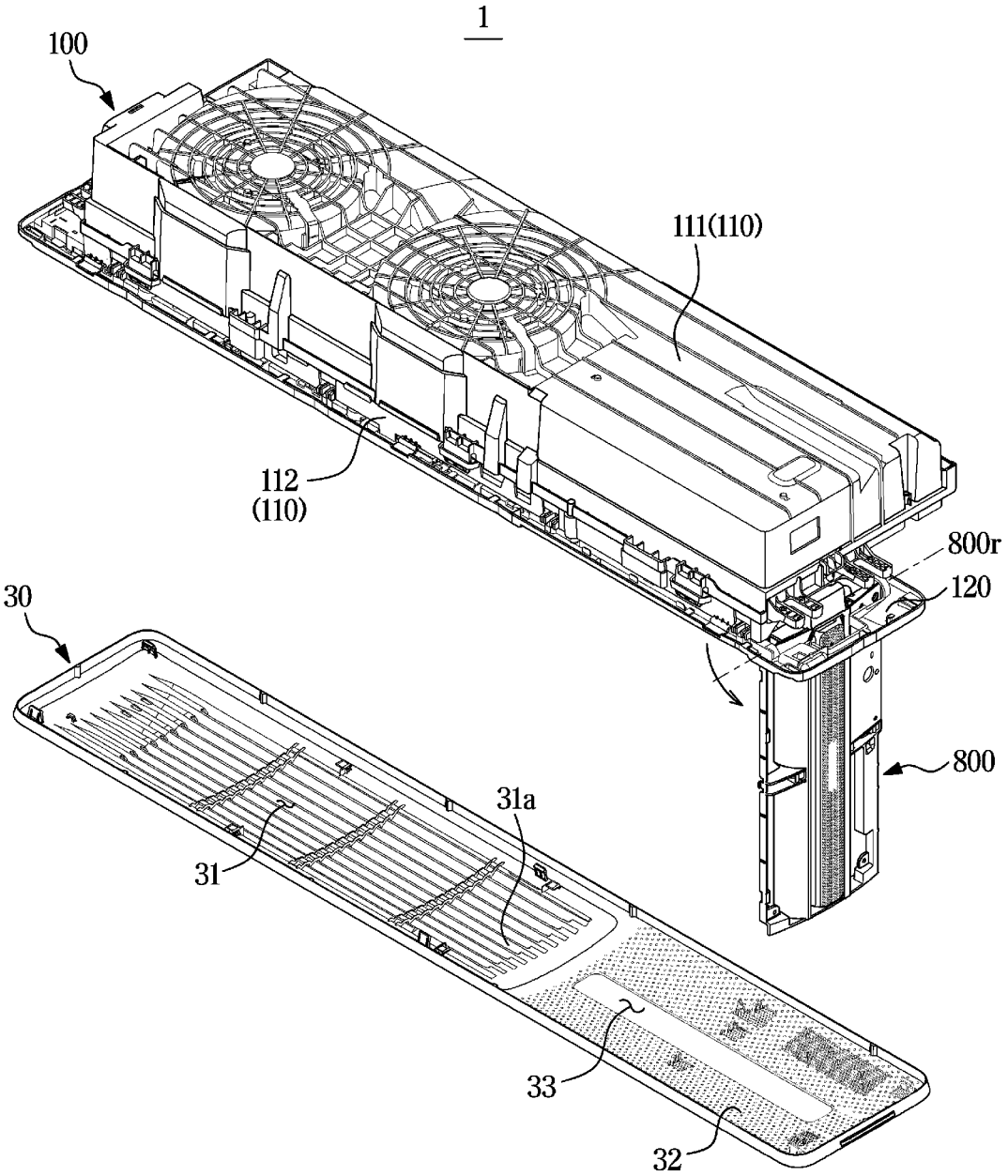
FIG. 2 is a top view of an air purifier with a grill of FIG. 1 taken apart to open a discharge assembly according to an embodiment of the disclosure.
Figure 3:
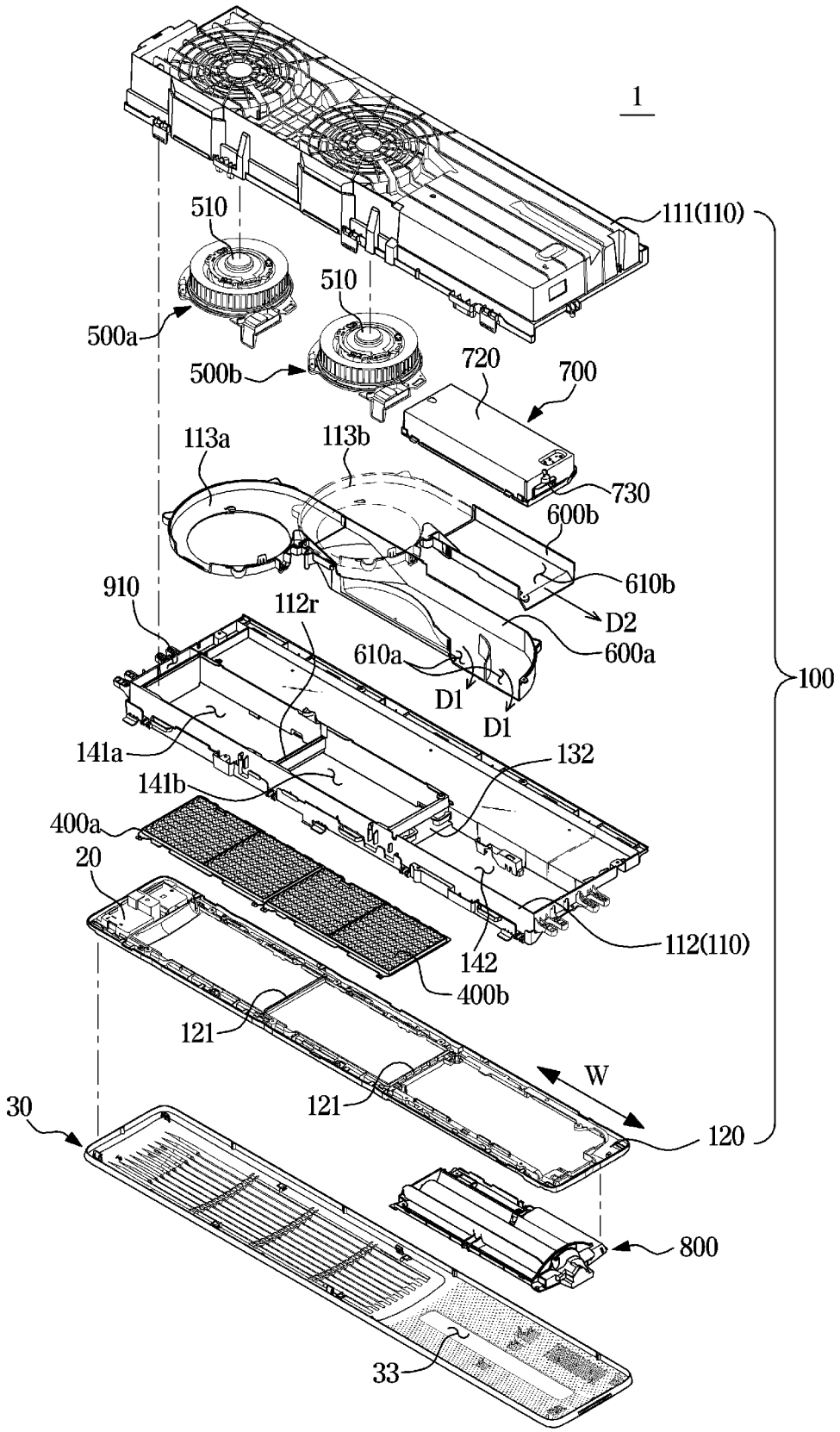
FIG. 3 is an exploded perspective view of an air purifier, according to an embodiment of the disclosure.
Figure 4:
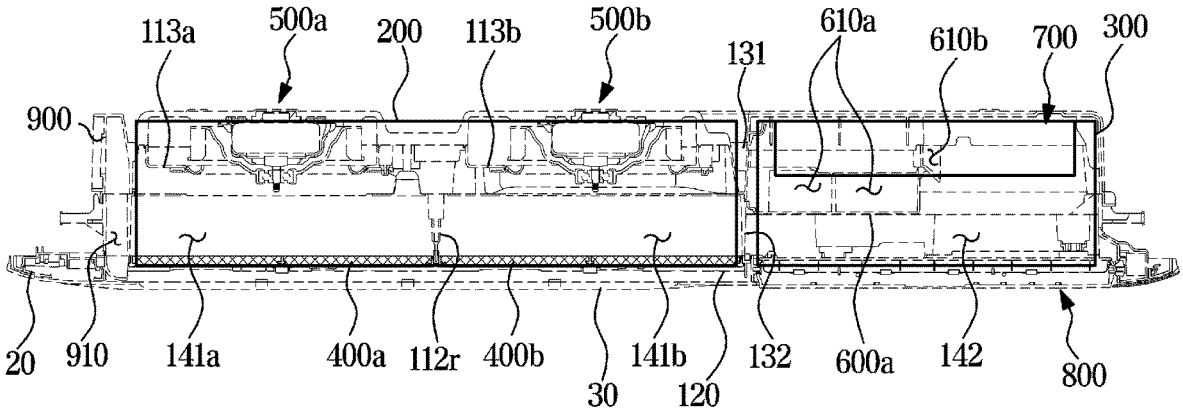
FIG. 4 is a cross-sectional view illustrating a filtration space and a convergent space of an air purifier, according to an embodiment of the disclosure.
Figure 5:
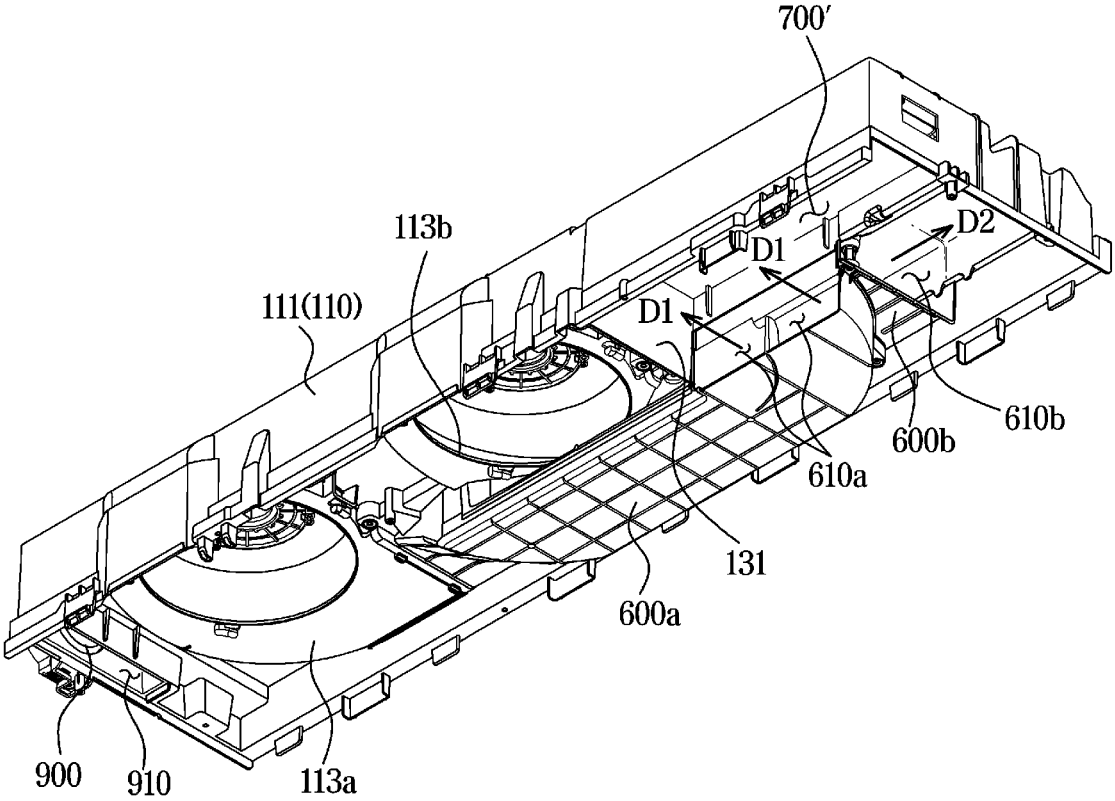
FIG. 5 is a perspective view of a combination of a first body housing, a flow path and a fan guard of FIG. 3 according to an embodiment of the disclosure.
Figure 6:
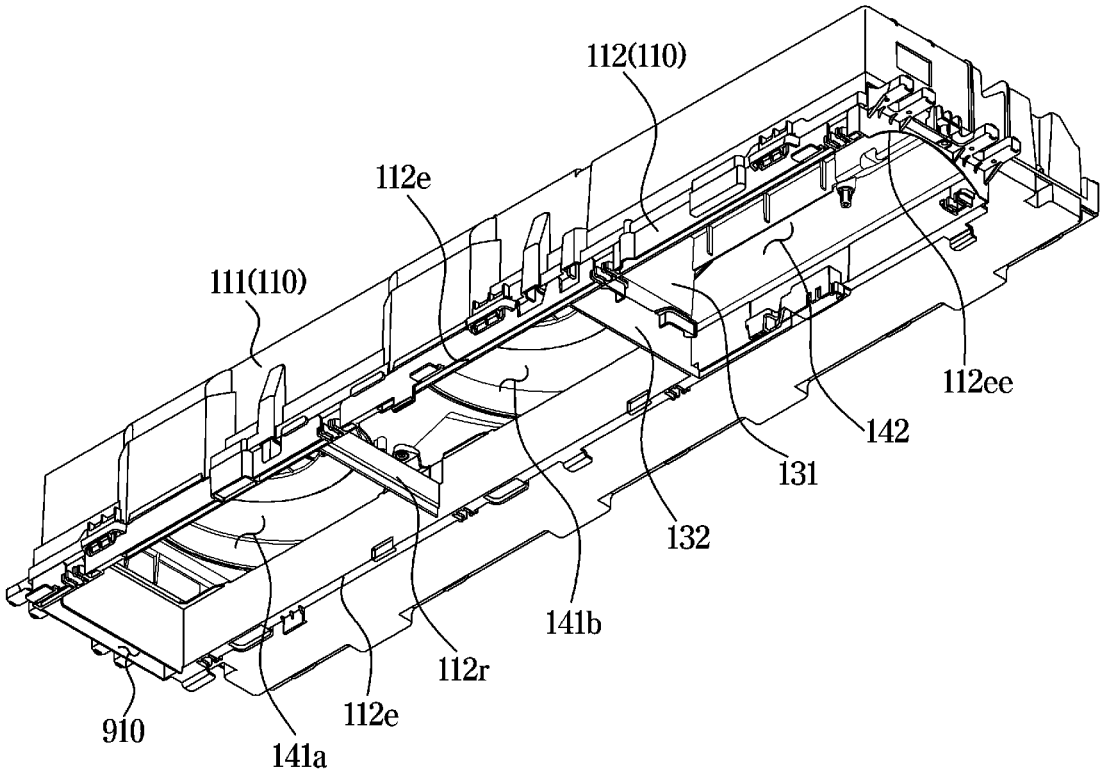
FIG. 6 is a perspective view of a combination of the first body housing and a second body housing of FIG. 3 according to an embodiment of the disclosure.

FIG. 1 illustrates an air purifier, according to an embodiment of the disclosure. FIG. 2 is a top view of an air purifier with a grill of FIG. 1 taken apart to open a discharge assembly. FIG. 3 is an exploded perspective view of an air purifier, according to an embodiment of the disclosure. FIG. 4 is a cross-sectional view illustrating a filtration space and a convergent space of an air purifier, according to an embodiment of the disclosure. FIG. 5 is a perspective view of a combination of a first body housing, a flow path and a fan guard of FIG. 3. FIG. 6 is a perspective view of a combination of the first body housing and a second body housing of FIG. 3.

For reference, FIG. 6 illustrates a combination of a first body housing and a second body housing after a flow path and a fan guard of FIG. 5 are removed, for convenience of explanation.

Referring to FIGS. 1 and 3, an air purifier 1 may include a housing 100, filters 400*a* and 400*b*, fans 500*a* and 500*b*, and a grill 30.

The air purifier 1 may further include a discharge assembly 800 through which filtered air passes in the process of being discharged from inside of the housing to outside of the housing. The discharge assembly 800 may be provided to control a discharge current of the filtered air. The discharge assembly 800 may be rotationally coupled with the housing.

Referring to FIG. 2, the discharge assembly 800 may be coupled with the housing 100 to be able to rotate on a rotation shaft 800*r* arranged at one end of the discharge assembly 800. A rotation mechanism of the discharge assembly 800 will be described later in detail.

The air purifier 1 may further include flow paths 600*a* and 600*b* in which air having passed the fans 500*a* and 500*b* may be moved to the discharge assembly 800.

An electric room 700 including electric components 710 (shown in FIG. 16) for driving and controlling components of the air purifier 1 may be included. Referring to FIG. 3, the electric room 700 includes an electric room box 720 in which the electric components 710 are arranged, and an electric room cover 730 for covering the electric components 710 not to be exposed to the outside of the electric room 700. The electric room cover 730 may be coupled with the electric room box 720.

In an embodiment of the disclosure, the air purifier 1 may be installed on a ceiling C. At least a portion of the air purifier 1 may be buried in the ceiling C. Specifically, the housing of the air purifier 1 may be buried in the ceiling C.

The grill 30 may be provided to cover the discharge assembly 800 and the filters 400*a* and 400*b* coupled with the housing 100. The grill 30 may be coupled with the lower side of the air purifier 1. The grill 30 may include a filter matching area 31 formed to match the filters 400*a* and 400*b*. The grill 30 may further include a discharge assembly matching area 32 to match the discharge assembly 800. The grill 30 may further include a blade opening 33 through which a discharge blade 820 (shown in FIG. 7) of the discharge assembly 800 is exposed to the outside. A grill blade 31*a* may be further included in the filter matching area 31 for outside air flowing into the air purifier 1 to be smoothly moved.

A plurality of micro holes 35 formed around the blade opening 33 may be provided in the discharge assembly matching area 32.

Referring to FIGS. 2 to 6, the housing 100 may be formed in the shape of a box with the open bottom to receive components of the air purifier 1. The housing 100 may include openings 141*a*, 141*b* and 142 (see FIG. 6) on the lower side.

The housing 100 may include a body housing 110 placed inside the ceiling C. The body housing 110 may include a first body housing 111 and a second body housing 112. The second body housing 112 may be coupled to the bottom of the first body housing 111. The first body housing 111 and the second body housing 112 may be separately manufactured and then coupled to each other for an efficient manufacturing process of the air purifier 1. The first body housing 111 and the second body housing 112 are coupled together to form the aforementioned shape of the box with the open bottom. It is not, however, limited thereto, and the first body housing 111 and the second body housing 112 may be integrally formed.

Referring to FIG. 4, the inside of the housing 100 may be partitioned into a filtration space 200 and a convergent space 300. The filtration space 200 and the convergent space 300 may be separated by partition plates 131 and 132. The partition plates 131 and 132 may be provided with the first partition plate 131 and the second partition plate 132. The first partition plate 131 may be formed in the first body housing 111. The second partition plate 132 may be formed in the second body housing 112. It is not, however, limited thereto, and when the first body housing 111 and the second body housing 112 are integrally formed, the first partition plate 131 and the second partition plate 132 may be integrally formed as well.

The filtration space 200 may be defined as a space in which air outside the air purifier 1 passes through the filters 400*a* and 400*b* and then flows into the fans 500*a* and 500*b*. The convergent space 300 may be defined as a space for receiving the filtered air that has passed the fans 500*a* and 500*b*. The filtered air in the convergent space 300 may be discharged back out of the air purifier 1 through the discharge assembly 800. The partition plates 131 and 132 may be provided to separate the filtration space 200 where the filters 400*a* and 400*b* and the fans 500*a* and 500*b* are installed from the convergent space 300 where the discharge assembly 800 is arranged.

Referring to FIGS. 3 and 6, after the first body housing 111 and the second body housing 112 are coupled, the openings 141*a*, 141*b* and 142 (see FIG. 6) located on the lower side of the housing 100 may be formed at the bottom of the second body housing 112. The openings 141*a*, 141*b* and 142 may be formed largely as inlet openings 141*a* and 141*b* and an outlet opening 142. The inlet openings 141*a* and 141*b* and the outlet opening 142 may be separated by the partition plates 131 and 132.

The inlet openings 141*a* and 141*b* may correspond to the filtration space 200, and the outlet opening 142 may correspond to the convergent space 300. In other words, the inlet openings 141*a* and 141*b* are openings on which the filters 400*a* and 400*b* are arranged and through which the air outside the air purifier 1 passes the filters 400*a* and 400*b* and then flows into the filtration space 200. The filtration space 200 may be placed above the inlet openings 141*a* and 141*b*. The outlet opening 142 is an opening on which the discharge assembly 800 is arranged and through which the filtered air in the convergent space 300 passes through the discharge assembly 800 and is discharged out of the air purifier 1. The convergent space 300 may be placed above the outlet opening 142.

The inlet openings 141*a* and 141*b* may include the first inlet opening 141*a* and the second inlet opening 141*b*.

The first inlet opening 141*a* and the second inlet opening 141*b* may be separated by a housing rib 112*r* formed on the housing 100. The housing rib 112*r* may perform a function of assisting distribution of an air current so that the air that has passed through the filters 400*a* and 400*b*, which will be described later, may effectively flow into the fans 500*a* and 500*b*. The housing rib 112*r* may be provided in the shape of a plate crossing the inlet openings 141*a* and 141*b*. It is not, however, limited thereto, and the housing rib 112*r* may be provided in various shapes to effectively separate the first inlet opening 141*a* from the second inlet opening 141*b*.

The housing rib 112*r* may be formed across the first body housing 111 and the second body housing 112. It is not, however, limited thereto, and the housing rib 112*r* may be formed only on the second body housing 112 and connected to a structure of the flow paths 600*a* and 600*b* and fan guards 113*a* and 113*b* arranged on the second body housing 112 to partition the filtration space. With the internal structure of the partitioned filtration space, the air current having passed through the filters 400*a* and 400*b* may be effectively distributed.

Specifically, the housing rib 112*r* may be formed on the second body housing 112 on which the openings 141*a*, 141*b* and 142 are formed. The housing rib 112*r* may be formed such that the first inlet opening 141*a* and the second inlet opening 141*b* have almost the same area. It is not, however, limited thereto, and there may be one inlet opening 141*a* and 141*b* formed without the housing rib 112*r*.

The number of the inlet openings 141*a* and 141*b* may correspond to the number of the fans 500*a* and 500*b* provided in the housing 100 of the air purifier 1.

In the air purifier 1 according to the embodiment, there may be two fans 500*a* and 500*b*, the first fan 500*a* and the second fan 500*b*, which will be described later. It is not, however, limited thereto, and there may be various numbers of fans 500*a* and 500*b* based on the volume of a target space for purification, and there may be various numbers of inlet openings 141*a* and 141*b* accordingly. In this case, the housing rib 112*r* may be formed to correspond to the number of the inlet openings 141*a* and 141*b*.

The housing 100 may further include an edge plate 120 matching edges of the body housing 110. Specifically, the edge plate 120 coupled with the lower side of the second body housing 112 of the body housing 110 may be further included. The edge plate 120 may be provided in a shape matching lower edges 112*e* of the second body housing 112. The lower edges of the second body housing 112 may refer to the edges 112*e* of the second body housing 112 that forms the openings 141*a*, 141*b* and 142.

A portion 112*ee* (see FIG. 6) of the edges 112*e* of the second body housing 112 may be provided to correspond to the shape of a discharge plate 810 of the discharge assembly 800, which will be described later.

The edge plate 120 may support the filters 400*a* and 400*b* and may be coupled onto the lower side of the housing 100. The edge plate 120 may support the discharge assembly and may be coupled onto the lower side of the housing 100. This will be described later in detail.

The edge plate 120 may be formed to match the edges 112*e* of the body housing 110 and may have the shape of substantially a rectangular ring. It is not, however, limited thereto, and may have various shapes formed to match the edges 112*e* of the body housing 110.

The edge plate 120 may further include edge plate ribs 121 to effectively support the filters 400*a* and 400*b*. The edge plate ribs 121 may increase mechanical strength of the edge plate 120. The edge plate ribs 121 may be formed at positions corresponding to the housing ribs 112*r*. The edge plate ribs 121 may be formed at positions corresponding to the partition plates 131 and 132.

The edge plate rib 121 may be provided in the shape of a rod that connects opposite edges of the edge plate 120. It is not, however, limited thereto, and may be provided in various shapes that may increase the mechanical strength of the edge plate 120.

The second body housing 112 and the edge plate 120 may be coupled by a fastening member (not shown). The fastening member (not shown) may be provided in a screw fastening mechanism or a hook fastening mechanism. It is not, however, limited thereto, and there may be various fastening mechanisms that securely maintain the fastening state of the second body housing 112 and the edge plate 120 in the vertical direction.

A sensor module 20 may be arranged on one side of the edge plate 120. The sensor module 20 may be placed near the electric room 700 of the air purifier 1, or in an embodiment of the disclosure, the sensor module 20 of the air purifier 1 may be placed on the other side from the side where the electric room 700 is arranged. The position of the sensor module 20 is not, however, limited thereto, and the sensor module 20 may be installed in various locations in the air purifier 1 to be able to effectively measure the contamination level of the target space for purification.

The filters 400*a* and 400*b* may be installed in the inlet openings 141*a* and 141*b*. The filters may purify the air flowing from outside into the housing 100 of the air purifier 1. The filters 400*a* and 400*b* may be arranged in the inlet openings 141*a* and 141*b* and fixed to the housing 100. The filters 400*a* and 400*b* may be fixed to the housing 100 by the edge plate 120 of the housing 100. The filters 400*a* and 400*b* may be arranged to match the shapes of the inlet openings 141*a* and 141*b*. The cross-section of the filter 400*a* or 400*b* may have the shape of almost a rectangle.

The filters 400*a* and 400*b* may include the first filter 400*a* and the second filter 400*b*. In other words, there may be a plurality of filters 400*a* and 400*b* arranged. The plurality of filters 400*a* and 400*b* may be provided to match the shapes or the number of the inlet openings 141*a* and 141*b*. In an embodiment, the air purifier may have two inlet openings, the first inlet opening 141*a* and the second inlet opening 141*b*, as described above, formed to match the filters 400*a* and 400*b*. It is not, however, limited thereto, but may be provided with a single filter. That is, there may be one filter regardless of the shapes or the number of the inlet openings 141*a* and 141*b*.

The fans 500*a* and 500*b* may be installed in the housing 100. The fans 500*a* and 500*b* may guide the air that has passed through the filters 400*a* and 400*b* to flow into the convergent space 300 from the filtration space 200.

The fans 500*a* and 500*b* may be provided in a cylindrical shape having relatively short height as compared to the diameter. The fans 500*a* and 500*b* may further include fan motors 510 at positions corresponding to the center of the cylinders to drive the fans 500*a* and 500*b*. The fans applied to an embodiment of the disclosure may be provided as a centrifugal fan. It is not, however, limited thereto, and various types of fans such as axial fans may be applied depending on the overall shape of the air purifier 1 and the layouts of the flow paths.

In an embodiment of the disclosure, the air purifier 1 may be provided with a plurality of fans. Referring to FIG. 3, in an embodiment of the disclosure, the air purifier 1 may include the first fan 500*a* and the second fan 500*b*.

The first fan 500*a* may be placed further apart from the outlet opening 142 than the second fan 500*b* in the housing. The first inlet opening 141*a* and the second inlet opening 141*b* may match the first fan 500*a* and the second fan 500*b*, respectively. It is not, however, limited thereto, and there may be one, or two or more fans provided.

The fan guards 113*a* and 113*b* may be provided in the housing 100. The flow paths 600*a* and 600*b* connected to the fan guards 113*a* and 113*b* may be provided in the housing 100. In an embodiment of the disclosure, the fan guards 113*a* and 113*b* and the flow paths 600*a* and 600*b* may be separately manufactured and then coupled to the housing 100. Specifically, the fan guards 113*a* and 113*b* and the flow paths 600*a* and 600*b* may be coupled onto a plane located on the top of the first housing 100. It is not, however, limited thereto, but the fan guards 113*a* and 113*b* and the flow paths 600*a* and 600*b* are arranged in the housing and integrally formed with the housing 100.

The fan guards 113*a* and 113*b* may be provided in the shapes matching the fans 500*a* and 500*b*. The fan guards 113*a* and 113*b* may be provided in the shapes that surround the fans 500*a* and 500*b*. The fan guards 113*a* and 113*b* may have substantially a semi-spherical form. The fan guards 113*a* and 113*b* may perform a function of delivering the air discharged in the circumferential direction of the fans 500*a* and 500*b* provided as centrifugal fans to the flow paths. The fan guards 113*a* and 113*b* may include holes at positions facing the inlet openings 141*a* and 141*b* to bring in the air having passed through the filters.

There may be a plurality of fan guards 113*a* and 113*b* to correspond to the number of the fans 500*a* and 500*b*. In an embodiment of the disclosure, the air purifier 1 may include the first fan 500*a* and the second fan 500*b*, and there may be the fan guards 113*a* and 113*b* which are the first fan guard 113*a* and the second fan guard 113*b* to correspond to the number of the fans as well. Referring to FIG. 3, the first fan guard 113*a* and the second fan guard 113*b* may be provided in the same shape.

The flow paths 600*a* and 600*b* may be connected to the fan guards 113*a* and 113*b*. The air discharged from the fans 500*a* and 500*b* may flow into the flow paths 600*a* and 600*b* by the fan guards 113*a* and 113*b*.

The flow paths 600*a* and 600*b* may be provided in the plural to correspond to the number of the fans 500*a* and 600*b*. In an embodiment of the disclosure, the air purifier 1 may include the first fan 500*a* and the second fan 500*b*, so that there may be the flow paths 600*a* and 600*b* which are the first flow path 600*a* and the second flow path 600*b* to correspond to the number of the fans as well. The first flow path 600*a* and the second flow path 600*b* may be arranged in the housing 100. Specifically, the first flow path 600*a* and the second flow path 600*b* may be arranged in the first body housing 111.

Referring to FIGS. 3 to 6, the first flow path 600*a* and the second flow path 600*b* may extend out from the first fan guard 113*a* and the second fan guard 113*b*, respectively. The length of the first flow path 600*a* connected to the first fan guard 113*a* may be shorter than the length of the second flow path 600*b* connected to the second fan guard 113*b*. The first flow path 600*a* and the second flow path 600*b* may be vertically stacked to make better use of the internal space of the housing 100. The first flow path 600*a* may be located under the second flow path 600*b*. The first flow path 600*a* may be formed such that a portion of a part forming the upper plane that forms the first flow path 600*a* overlaps a portion of a part forming the lower plane of the second flow path 600*b*.

Walls that define the flow paths 600*a* and 600*b* may separate the convergent space 300 from the filtration space 200 together with the partition plates 131 and 132. The filtration space 200 and the convergent space 300 may be connected to each other through the flow paths 600*a* and 600*b*.

The air having passed the flow paths 600*a* and 600*b* may be discharged into the convergent space 300 through flow path outlets 610*a* and 610*b* formed at one ends of the flow paths 600*a* and 600*b*. The first flow path outlet 610*a* may be formed at one end of the first flow path 600*a*. The second flow path outlet 610*b* may be formed at one end of the second flow path 600*b*.

Referring to FIG. 5, the first flow path 600*a* is placed under the second flow path 600*b*, and the first flow path outlet 610*a* of the first flow path 600*a* may be placed under the second flow path outlet 610*b* of the second flow path. The filtered air may be discharged into the convergent space 300 through the first flow path outlet 610*a* and the second flow path outlet 610*b*.

A discharge direction D1 in which the air is discharged through the first flow path outlet 610*a* may be different from a discharge direction D2 in which the air is discharged through the second flow path outlet 610*b*. Specifically, the discharge directions may form almost 90°.

The discharge direction D1 of the air discharged through the first flow path outlet 610*a* may be toward an electric room placement area 700'. The discharge direction D2 of the air discharged through the second flow path outlet 610*b* may be parallel to the electric room placement area 700'. In other words, the discharge direction D2 of the air discharged through the second flow path outlet 610*b* may not be toward the electric room placement area 700'.

Referring to FIGS. 5 and 6, on one side of the housing 100, an energy recovery ventilator (ERV) connector 900 connected to an ERV placed outside the air purifier 1 may be provided. The ERV may refer to a heat exchanger that takes energy (heat) from the indoor air and transfers the energy to outside air brought in from outside when the indoor air is discharged to the outside for ventilation.

In an embodiment of the disclosure, the air purifier may bring air outside the air purifier 1 discharged from the ERV into the air purifier 1 through the ERV connector 900.

The air brought into the air purifier 1 through the ERV connector 900 may flow into the air purifier 1 through an outside air flow path 910. This will be described later in detail.

Figure 7:
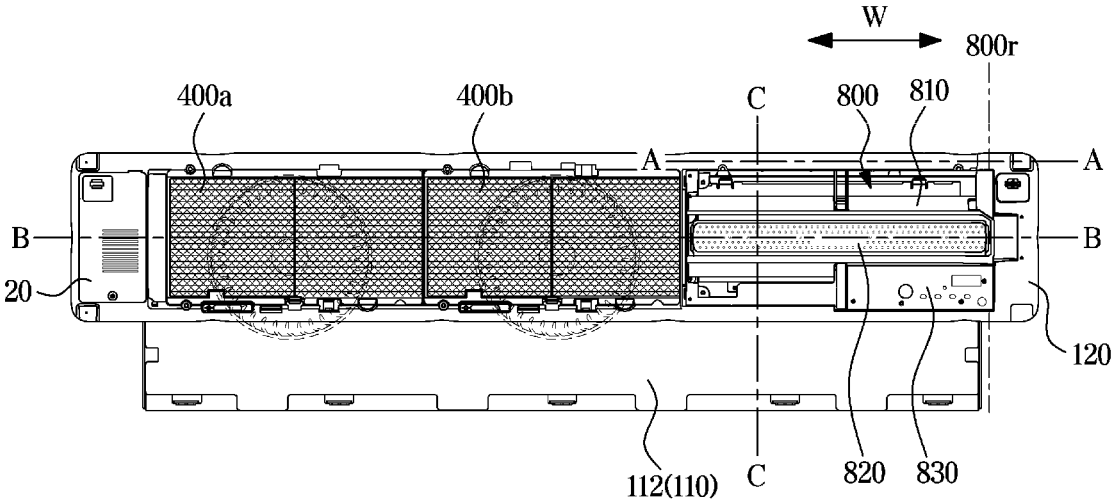
FIG. 7 is a bottom view of an embodiment of the disclosure with a grill removed.
Figure 8:
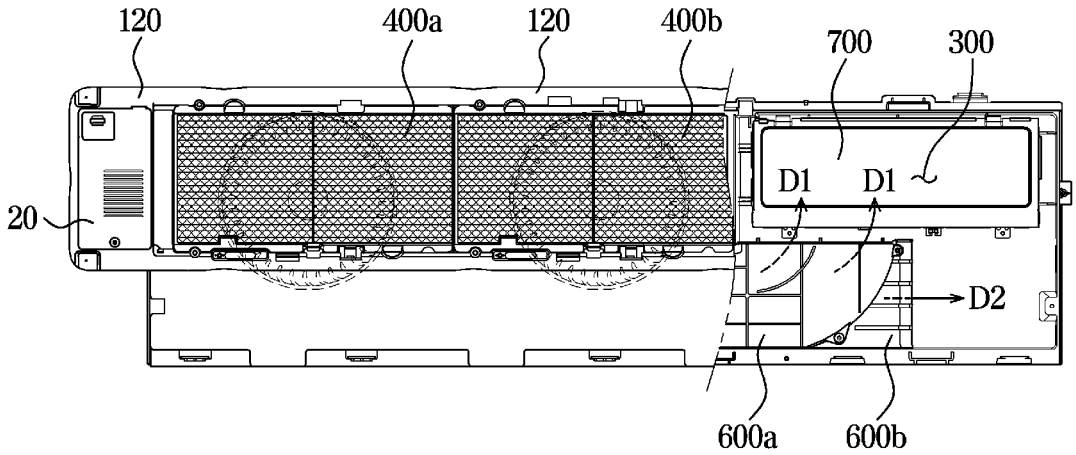
FIG. 8 is a bottom view with a discharge assembly removed from FIG. 7 according to an embodiment of the disclosure.

FIG. 7 is a bottom view of an embodiment with a grill removed. FIG. 8 is a bottom view with a discharge assembly removed from FIG. 6. For reference, FIG. 7 illustrates the second body housing 112 with a portion of the second body housing 112 corresponding to an area where the flow path outlets 610*a* and 610*b* of the flow paths 600*a* and 600*b* are located removed therefrom.

The discharge assembly 800 and the electric room 700 will now be described in detail.

The air purifier 1 may include the discharge assembly 800 for discharging the filtered air in the convergent space 300.

The air purifier 1 further includes the electric room 700 including electric components 710 for driving and controlling components of the air purifier 1 such as a blade motor 840, the sensor module 20 and the fan motor 510 included in the discharge assembly 800.

The traditional ceiling type air purifier has an electric room placed in a separate space from a space in which the filtered air is moved, leading to an increase in overall volume of the air purifier. Furthermore, a fixing process may be complicated because all the grill, the panel, and the discharge device for discharging the filtered air need to be taken apart from the ceiling to fix the electric room placed in the air purifier.

In an embodiment of the disclosure, the air purifier 1 may have the electric room 700 installed in the convergent space 300 where the filtered air is received, to eliminate the need for an extra space for installing the electric room, thereby reducing the overall volume of the air purifier 1.

In an embodiment of the disclosure, the air purifier 1 may allow access to the internal space of the air purifier 1 while the discharge assembly 800 is connected to the housing 100 even when opened by a rotation operation without a need to completely take the discharge assembly 800 apart from the housing 100.

In an embodiment of the disclosure, with the discharge assembly 800 arranged under the convergent space 300 and the electric room 700 arranged in the convergent space 300, the air purifier 1 may allow easy access to the electric room 700 when the discharge assembly 800 is opened by a rotation operation.

Referring to FIGS. 7 and 8, the discharge assembly 800 may be arranged on one side of the openings 141*a*, 141*b* and 142 of the housing 100. Specifically, the discharge assembly 800 may be arranged on the outlet opening 142 of the housing 100. Hence, the discharge assembly 800 may be placed on one side to the filter 400*a* or 400*b* arranged on the inlet opening 141*a* or 141*b*. Specifically, in an embodiment of the disclosure, the air purifier 1 may include the first filter 400*a* and the second filter 400*b*, and the discharge assembly 800 may be arranged on one side to the second filter 400*b*.

The discharge assembly 800 may be rotationally coupled to the housing 100. Specifically, the discharge assembly 800 may be coupled with the housing 100 to be able to rotate on the rotation shaft 800*r* arranged at one end of the discharge assembly 800. The discharge assembly 800 may be rotationally coupled with the edge plate 120 of the housing 100. This will be described later in detail.

Referring to FIG. 8, as described above, the filtered air may be discharged into the convergent space 300 through the first flow path 600*a* and the second flow path 600*b*. The discharge direction D1 in which the air is discharged through the first flow path 600*a* may be different from the discharge direction D2 in which the air is discharged through the second flow path 600*b*. Specifically, the discharge directions may form almost 90°.

The discharge direction D1 of the air discharged through the first flow path 600*a* may be toward an electric room placement area 700'. The discharge direction D2 of the air discharged through the second flow path 600*b* may be parallel to the electric room placement area 700'. In other words, the discharge direction D2 of the air discharged through the second flow path 600*b* may not be toward the electric room placement area 700'.

As seen in FIG. 8, the electric room 700 may be arranged in the convergent space 300. Specifically, the electric room 700 may be fixed to the top of the housing 100 to be arranged in the convergent space 300. The electric room 700 may be fixed to the top of one side of the first body housing corresponding to the convergent space 300.

Referring to FIGS. 7 and 8, the discharge assembly 800 is placed under the electric room 700, so the electric room 700 arranged in the convergent space 300 may be accessed right away when the discharge assembly 800 is opened.

A detailed structure and mechanism of being rotationally coupled to the housing 100 of the discharge assembly 800 will now be described.

Figure 9:
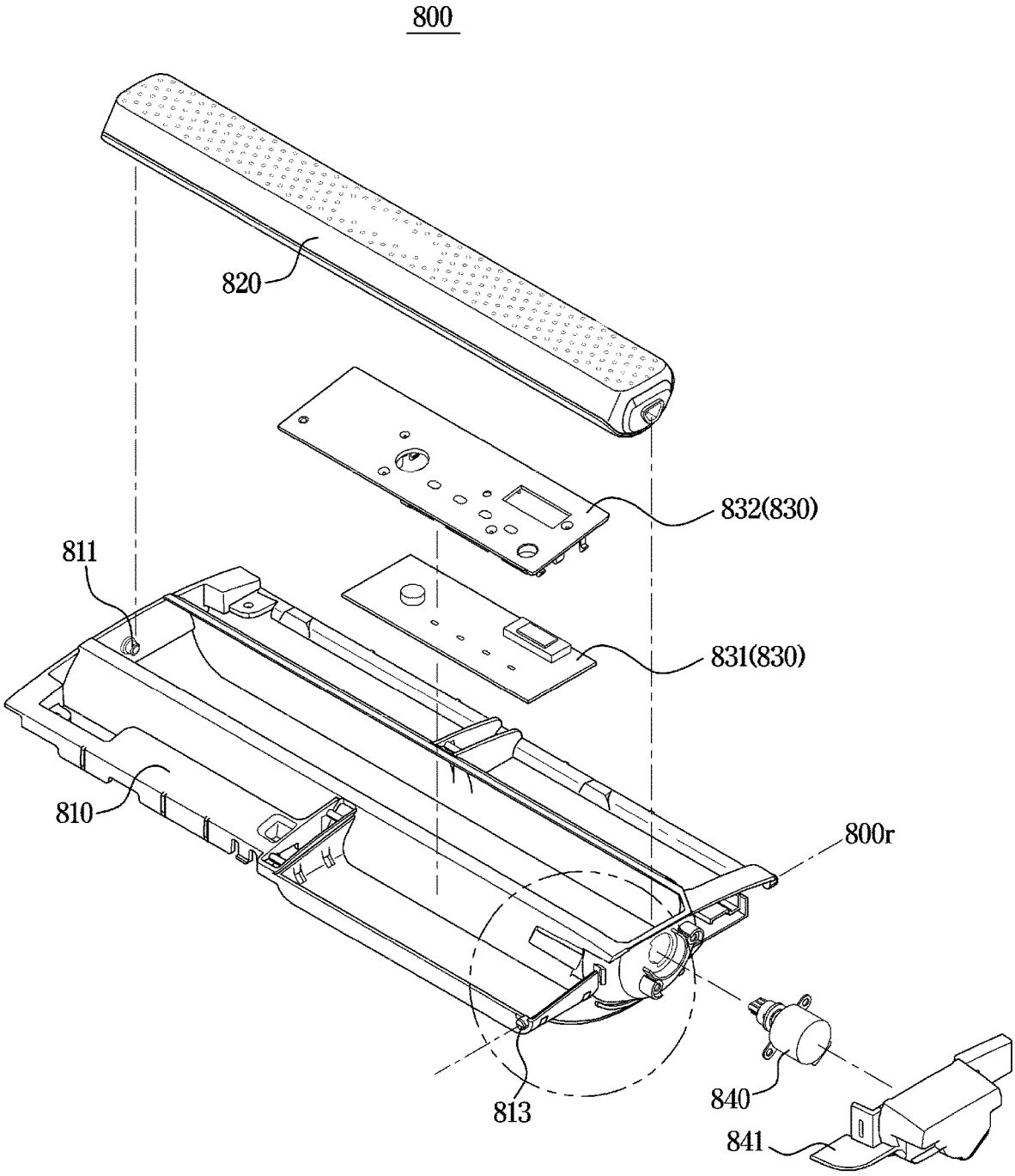
FIG. 9 is an exploded perspective view of a discharge assembly of an air purifier, according to an embodiment of the disclosure.
Figure 10:
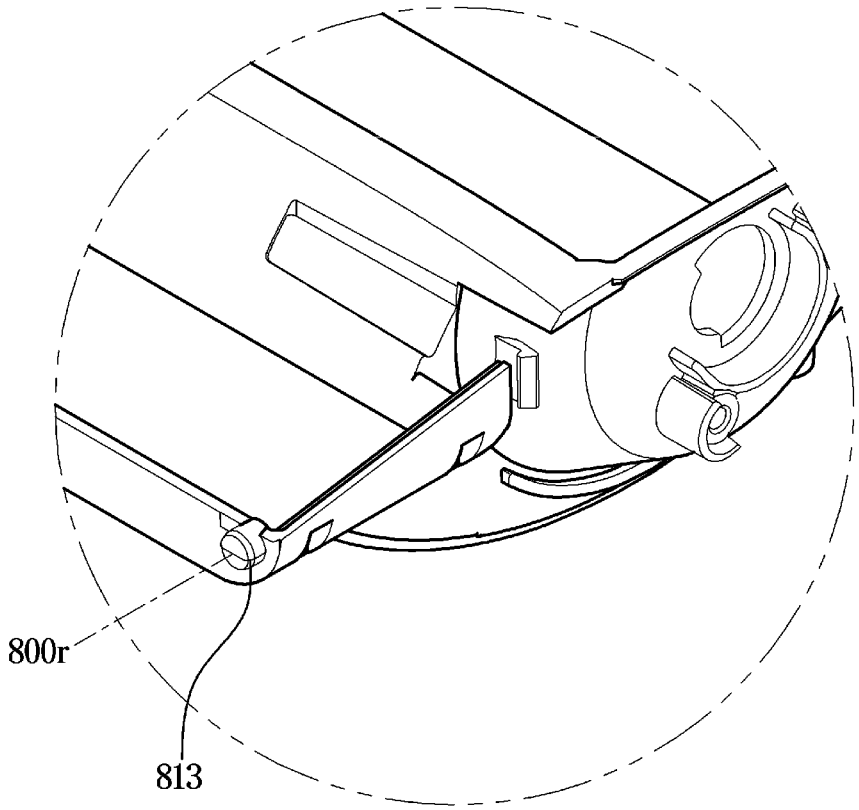
FIG. 10 is an enlarged view of a Y1 region of FIG. 9 according to an embodiment of the disclosure.
Figure 11:
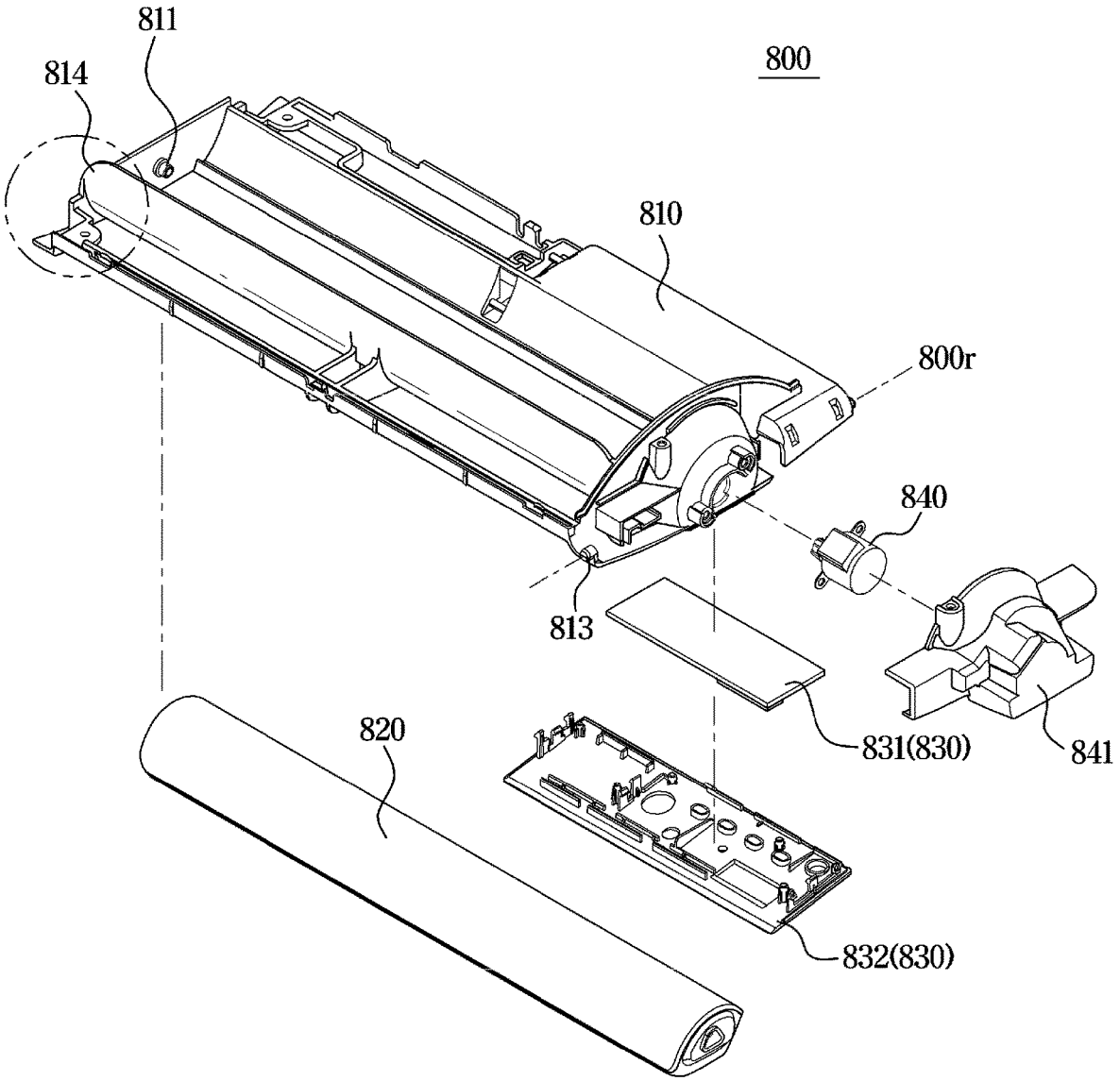
FIG. 11 is a diagram of FIG. 9 viewed from an opposite direction according to an embodiment of the disclosure.
Figure 12:
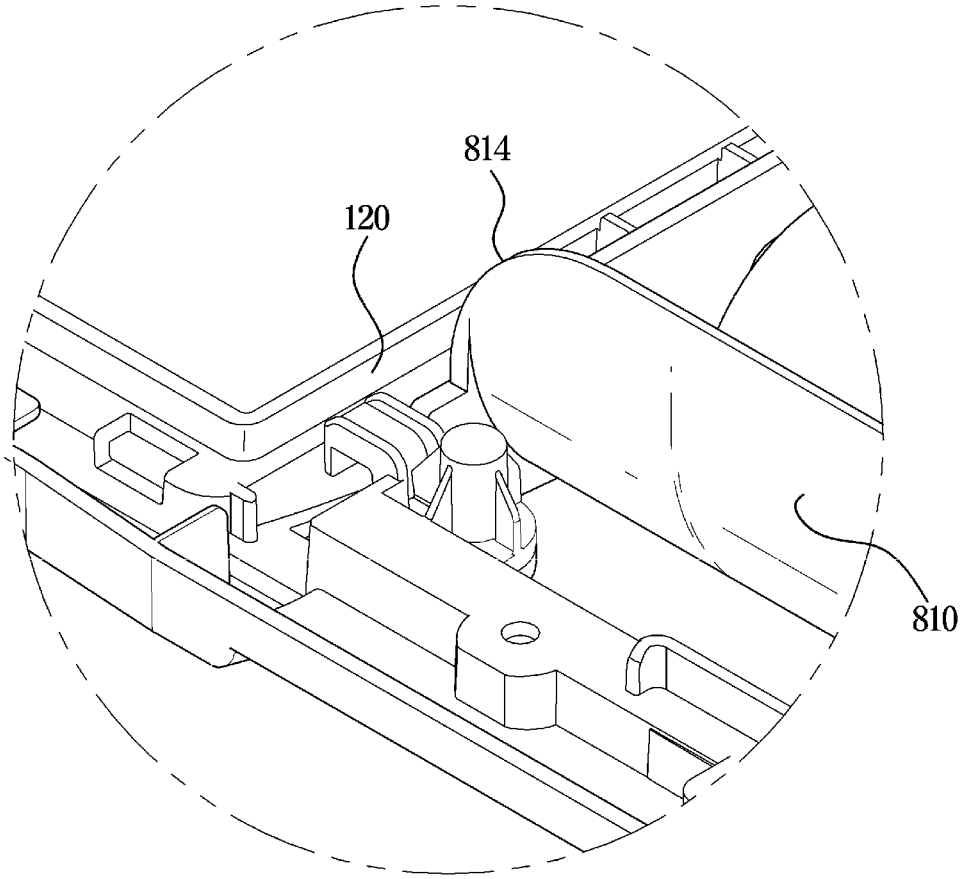
FIG. 12 is an enlarged view of a Y2 region of FIG. 11 according to an embodiment of the disclosure.
Figure 13:
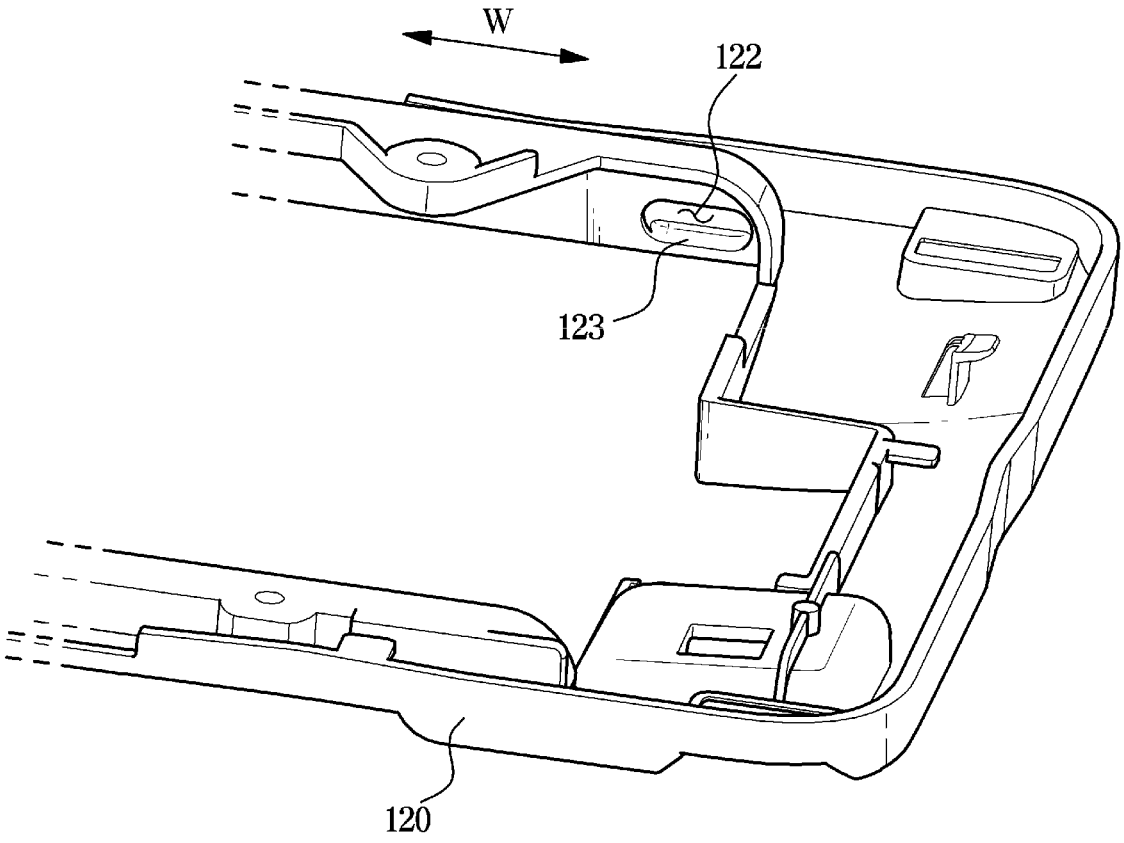
FIG. 13 is an enlarged view of a portion in which a settling groove is formed on an edge plate of an air purifier, according to an embodiment of the disclosure.
Figure 14:
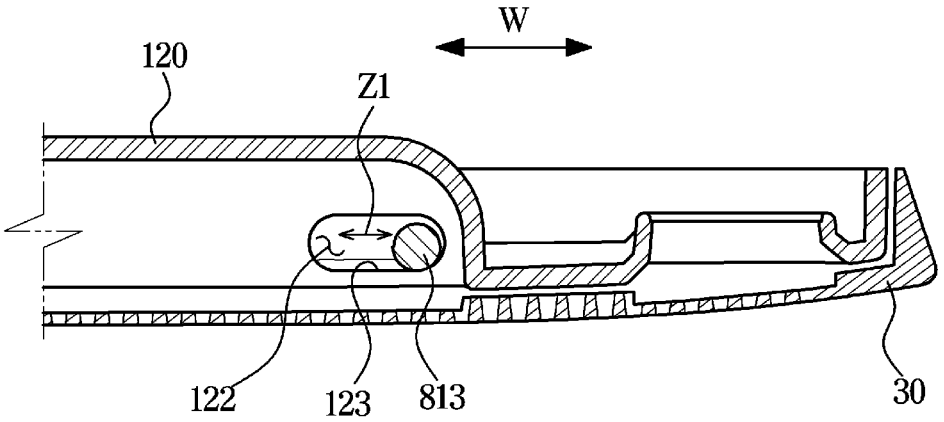
FIG. 14 is a cross-sectional view along A-A of FIG. 7 according to an embodiment of the disclosure.

FIG. 9 is an exploded perspective view of a discharge assembly of an air purifier, according to an embodiment. FIG. 10 is an enlarged view of a Y1 region of FIG. 9. FIG. 11 is a diagram of FIG. 9 viewed from an opposite direction. FIG. 12 is an enlarged view of a Y2 region of FIG. 11. FIG. 13 is an enlarged view of a portion in which a settling groove is formed on an edge plate of an air purifier, according to an embodiment. FIG. 14 is a cross-sectional view along A-A of FIG. 7.

The discharge assembly 800 may include a discharge plate 810 and a discharge blade 820. The discharge plate 810 may be formed to match the bottom of the convergent space 300. The discharge plate 810 may be formed to match the shape of the outlet opening 142 located under the convergent space 300. In an embodiment of the disclosure, the discharge plate 810 of the air purifier 1 may be formed in an almost rectangular shape. It is not, however, limited thereto, but may be formed in various shapes corresponding to the shape of the outlet opening 142 to effectively discharge the filtered air.

The discharge assembly 800 may further include a display 830 for displaying operating status of the air conditioner 1 for the user through the grill 30. The display 830 may further include a substrate 831 on which light emitting diodes (LEDs) and other electric components are mounted, and a substrate plate 832 on which the substrate 831 is mounted. The substrate 831 may be fixed to the substrate plate 832. The substrate plate 832 may be coupled with the discharge plate 810.

The discharge assembly 800 may include the discharge blade for controlling a moving direction of the air discharged from the convergent space. The discharge blade 820 may include an eccentric rotation shaft and may have the form of substantially a cylinder. The discharge blade 820 may be placed in the middle area of the discharge plate 810. The discharge blade 820 may be rotationally coupled to the discharge plate 810. An end of the discharge blade 820 may be supported by a blade supporter 811 formed on the discharge plate 810.

The other end of the discharge blade 820 may be supported by a rotation shaft of the blade motor 840 that rotates the discharge plate 810. The blade motor 840 may be coupled to the other side of the discharge plate 810 facing the side on which the blade supporter 811 is formed. The discharge assembly 800 may further include a motor cover 841 for covering the blade motor 840.

Referring to FIGS. 9 to 14, the discharge plate 810 may further include a shaft projection 813 arranged on the rotation shaft 800*r* and formed at one side of the discharge plate 810. The shaft projection 813 of the discharge plate 810 may be inserted to a settling groove 122 formed on the discharge plate 810 of the housing 100, which will be described later.

The discharge assembly 800 may be coupled with the housing 100 to be able to rotate on the rotation shaft 800*r* arranged at one end of the discharge assembly 800 with the shaft projection 813 and the settling groove 122. The shaft projection 813 may be formed at either end of an edge of the discharge plate 810 on which the rotation shaft 800*r* is arranged, so that the convergent space 300 is fully exposed through the lower side of the air purifier 1 while the discharge assembly 800 is rotated and opened.

In an embodiment of the disclosure, the air purifier 1 may have the shaft projection 813 formed at either end of a shorter edge among edges of the discharge plate 810.

Specifically, the discharge plate 810 may be formed to match the bottom of the convergent space 300. The discharge plate 300 may be formed to have substantially rectangular edges. The edges of the discharge plate 300 may include four edges. The rotation shaft 800*r* may be arranged along a short edge located at one side of the discharge assembly 810 among the four edges.

The shaft projection 813 may protrude from the edge of the discharge plate 810 along the rotation shaft 800*r*. In other words, the shaft projection 813 may protrude from either end of an edge on which the rotation shaft 800*r* is arranged among the edges of the discharge plate 810 along the rotation shaft 800*r*. Or, the shaft projection 813 may protrude from either end of a side on which the rotation shaft 800*r* is arranged among the sides of the discharge plate 810 along the rotation shaft 800*r*. The shaft projection 813 may be arranged on the rotation shaft 800*r* and formed at one side of the discharge plate 810. The shaft projection 813 may be provided in a substantially cylindrical shape. It is not, however, limited thereto, but may be formed at either end of a long edge of the edges of the discharge plate 810 as long as the convergent space 300 is completely exposed through the lower side of the air purifier 1 while the discharge assembly 800 is rotated and opened.

Alternatively, the discharge plate 810 may be provided in various forms that may match the bottom of the convergent space 300 to effectively open or close the convergent space 300.

Referring to FIG. 12, the discharge plate 810 may further include a buffer 814 for relieving the shock that may occur in the process of opening or closing the discharge assembly 800. The buffer 814 may be formed to include a curved plane on the top of the other side.

The discharge assembly 800 may be coupled with the housing 100 to be able to rotate on the rotation shaft 800*r* arranged on one side of the discharge plate 810. Accordingly, with the buffer 814 arranged on the top of the other side, shocks that may occur between the discharge assembly 800 and the housing 100 may be relieved. As will be described later, the discharge assembly 800 may be rotationally coupled with the edge plate 120 of the housing 100. To relieve blocking or shocks with the edge plate 120 in the process of the discharge assembly 800 closing the convergent space 300, the buffer 814 having a curved plane may be formed on the discharge plate 810.

Referring to FIGS. 13 and 14, the edge plate 120 of the housing 100 may further include the settling groove 122 to which the shaft projection 813 is inserted for the discharge assembly 800 to be able to rotate against the housing 100. The settling groove 122 may be formed on one side of the edge plate 120 that matches the shaft projection 813.

The settling groove 122 may include a guide plane 123 for allowing the shaft projection 813 to rotate or slide. The guide plane 123 may extend in a direction Z1 in parallel with an edge extension direction W of the edge plate 120 on which the settling groove 122 is formed. The extension length of the guide plane 123 may be longer than a diameter of the shaft projection 813. The shaft projection 813 may be able to slide along the guide plane in the direction Z1 in parallel with the edge extension direction W of the edge plate 120 on which the settling groove 122 is formed. The shaft projection 813 may perform rotation or sliding separately or simultaneously.

In an embodiment of the disclosure, the air purifier 1 may effectively open or close the convergent space 300 because the shaft projection 813 of the discharge assembly 800 is able to rotate or slide.

Figure 15:
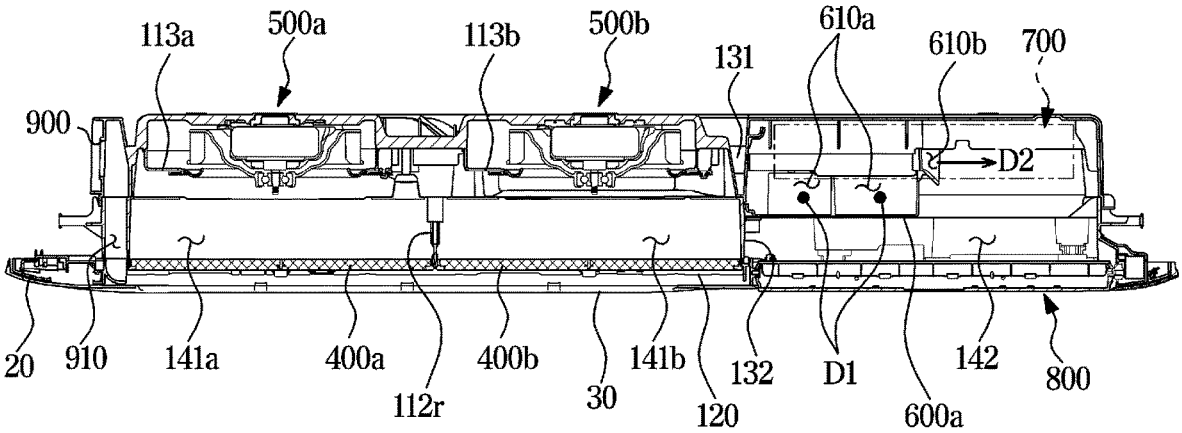
FIG. 15 is a cross-sectional view along B-B of FIG. 7 according to an embodiment of the disclosure.
Figure 16:
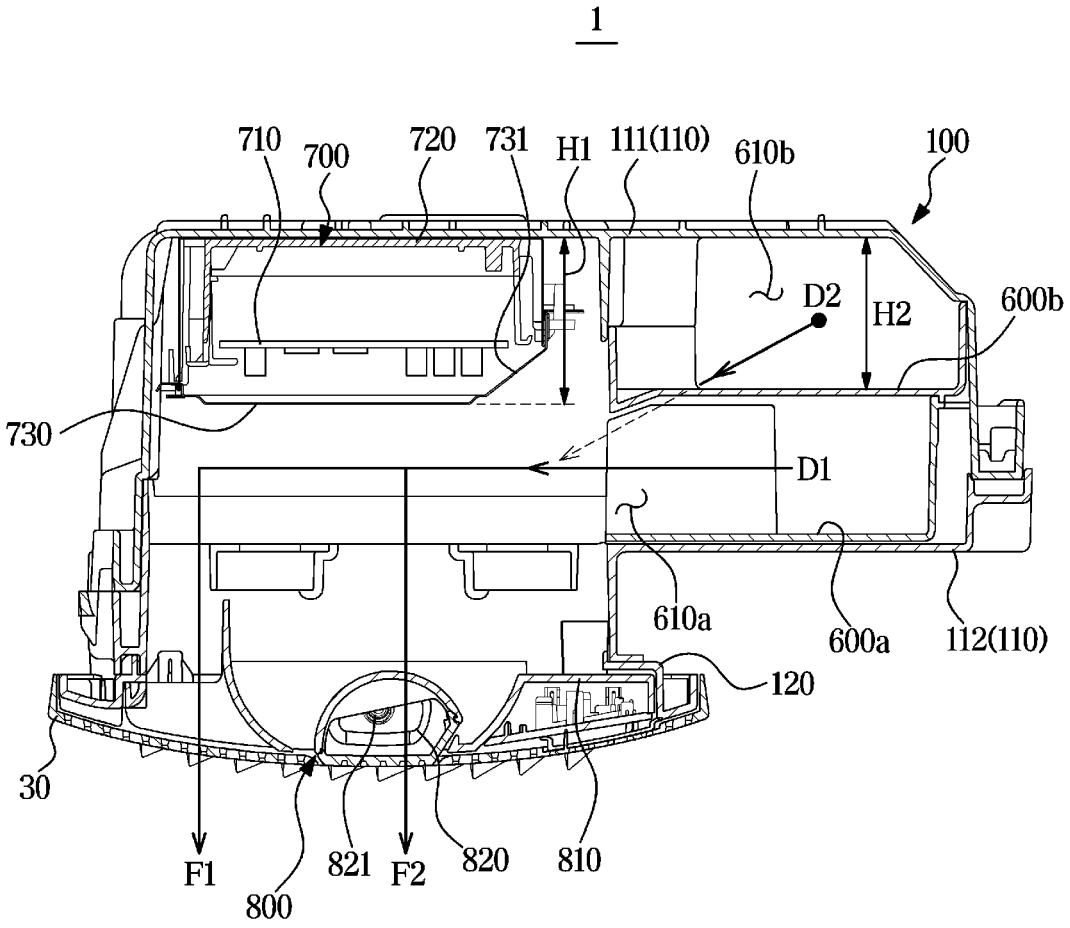
FIG. 16 is a cross-sectional view along C-C of FIG. 7 according to an embodiment of the disclosure.

FIG. 15 is a cross-sectional view along B-B of FIG. 7. FIG. 16 is a cross-sectional view along C-C of FIG. 7.

Flows of air and positional relations between the electric room 700, the flow path outlets 610*a* and 610*b* of the flow paths 600*a* and 600*b*, and the discharge assembly 800 will now be described in connection with FIGS. 15 and 16.

The air outside the air purifier 1 may flow in through a total heat exchanger connector 900, the outside air flow path 910, and a filter matching area 31 of the grill 30. The air may then be filtered through the filters 400*a* and 400*b*. The air passing through the filters 400*a* and 400*b* may flow to the fans 500*a* and 500*b*. The filtered air may be moved from the filtration space 200 where the filters 400*a* and 400*b* and fans 500*a* and 500*b* are arranged to the convergent space 300 through the flow paths 600*a* and 600*b*.

The filtered air may be discharged into the convergent space 300 through the first flow path outlet 610*a* and the second flow path outlet 610*b*. In this case, the flow path outlets 610*a* and 610*b* may be arranged on at least one of the lower side or circumference of the electric room 700.

Referring to FIGS. 15 and 16, specifically, the discharge direction D1 of the filtered air discharged through the first flow path 600*a* may be toward the electric room placement area 700'. The discharge direction D2 of the filtered air discharged through the second flow path 600*b* may be parallel to the electric room placement area 700'. In other words, the discharge direction D2 of the filtered air discharged through the second flow path 600*b* may not be toward the electric room placement area 700'. As the first flow path 600*a* may be located under the second flow path 600*b*, the first flow path outlet 610*a* formed at one end of the first flow path 600*a* may be arranged on the lower side of the electric room 700. The second flow path outlet 610*b* formed at one end of the second flow path may be arranged on the circumference of the electric room 700.

The filtered air discharged from the second flow path outlet 610*b* may be moved to the lower side of the electric room 700, and may then pass through the discharge assembly along the housing 100 and may be discharged out of the air purifier 1. The filtered air discharged from the first flow path outlet 610*a* may be moved in parallel with the electric room 700, and may then pass through the discharge assembly along the housing 100 and may be discharged out of the air purifier 1.

The discharge assembly 800 may be arranged under the flow path outlets 610*a* and 610*b*. The filtered air may be discharged to the outside through the plurality of micro holes 35 formed around the blade opening 33 of the discharge assembly matching area 32 of the grill 30 (F1), or discharged through the blade opening 33 of the discharge assembly matching area 32 of the grill 30 (F2), depending on a rotated state of the discharge blade 820 of the discharge assembly 800.

Figure 17:
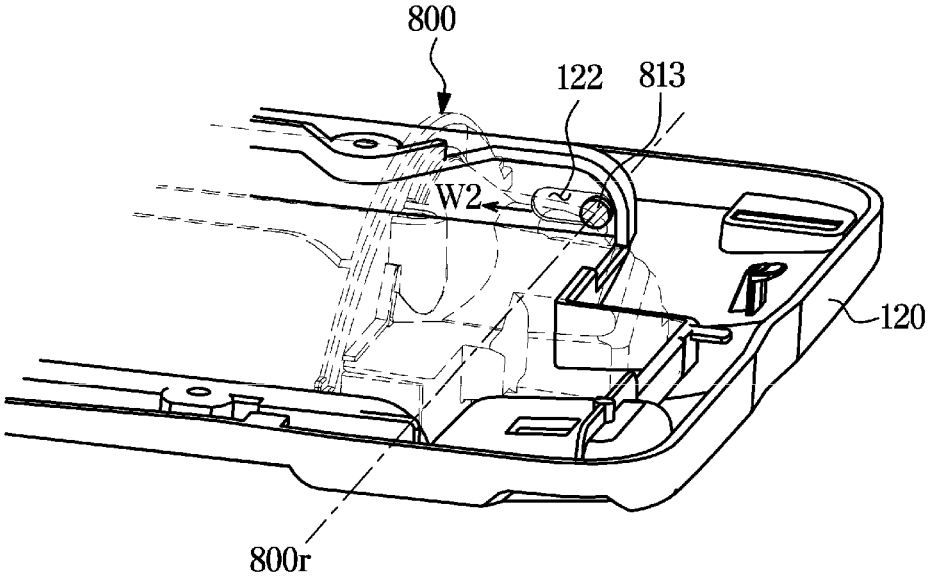
FIG. 17 illustrates an air purifier with a discharge assembly closed, according to an embodiment of the disclosure.
Figure 17:
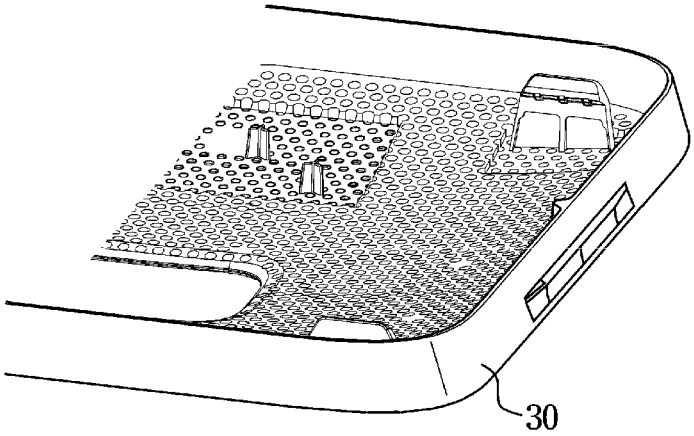
Figure 18:
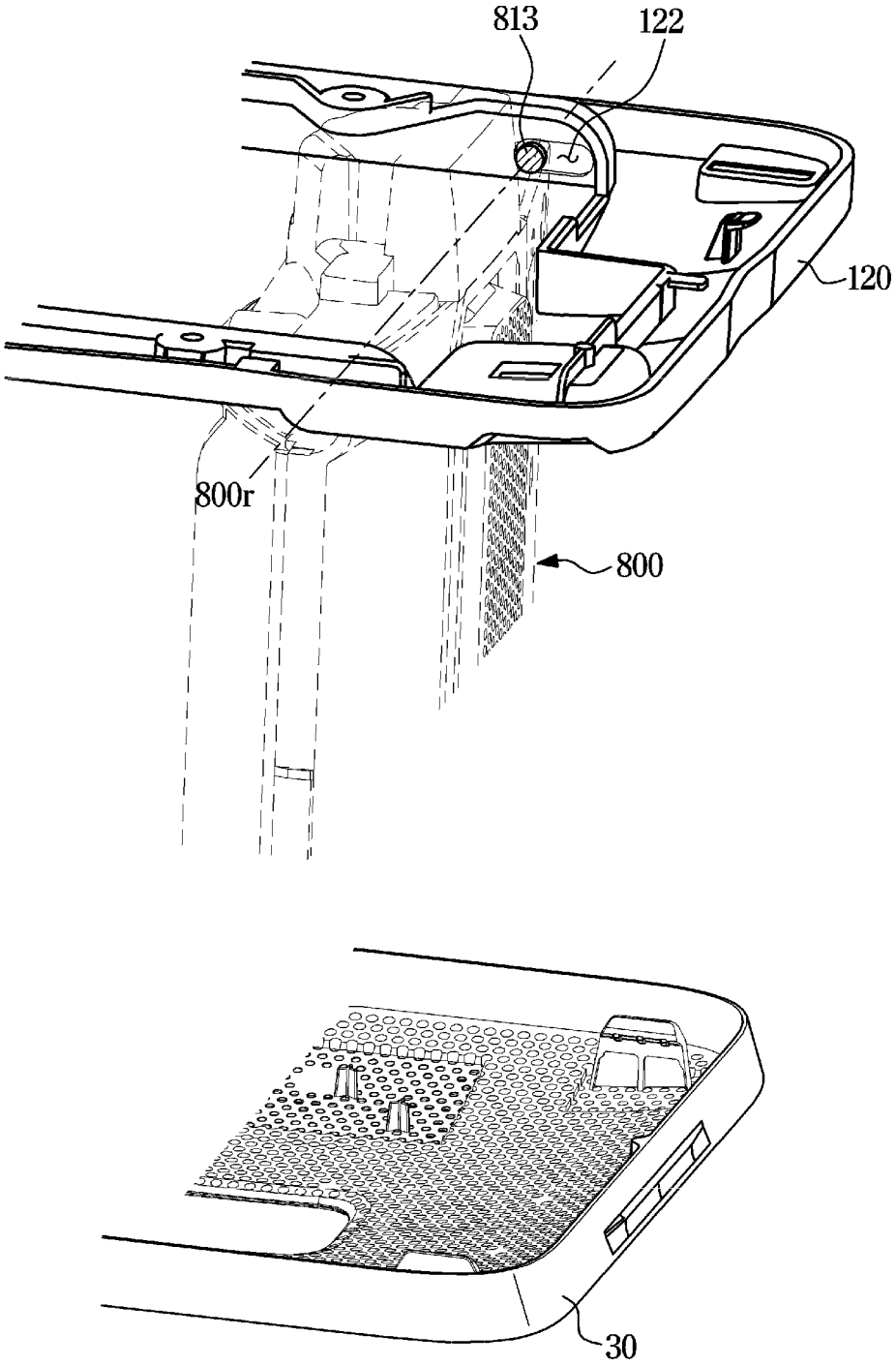
FIG. 18 illustrates an air purifier with a discharge assembly opened, according to an embodiment of the disclosure.

FIG. 17 illustrates an air purifier with a discharge assembly closed, according to an embodiment. FIG. 18 illustrates an air purifier with a discharge assembly opened, according to an embodiment.

An operation of the discharge assembly 800 opening the convergent space will now be described in connection with FIGS. 17 and 18.

To access the convergent space 300 in the air purifier 1 or the electric room 700 arranged in the convergent space 300, the user may detach the grill 30 coupled to the housing 100. In this case, the discharge assembly 800 is fixed to the edge plate 120 of the housing 100 in a state of closing the convergent space 300.

Then, with respect to the rotation shaft 800*r* arranged at one end of the discharge assembly 800, the other end may be forced to rotate downward from the air purifier 1. Specifically, the discharge assembly 800 may be rotated based on the settling groove 122 and the shaft projection 813 inserted to the settling groove 122. The user may move the discharge assembly 800 such that the rotation shaft 800*r* of the discharge assembly 800 slides in a direction W2 in which the filters 400*a* and 400*b* are arranged. The rotating and sliding of the discharge assembly 800 may be performed separately or simultaneously, and the convergent space 300 may be opened toward the outside of the air purifier 1.

An operation of the discharge assembly 800 closing the convergent space may be done by reversely performing the aforementioned procedure.

Figure 19:
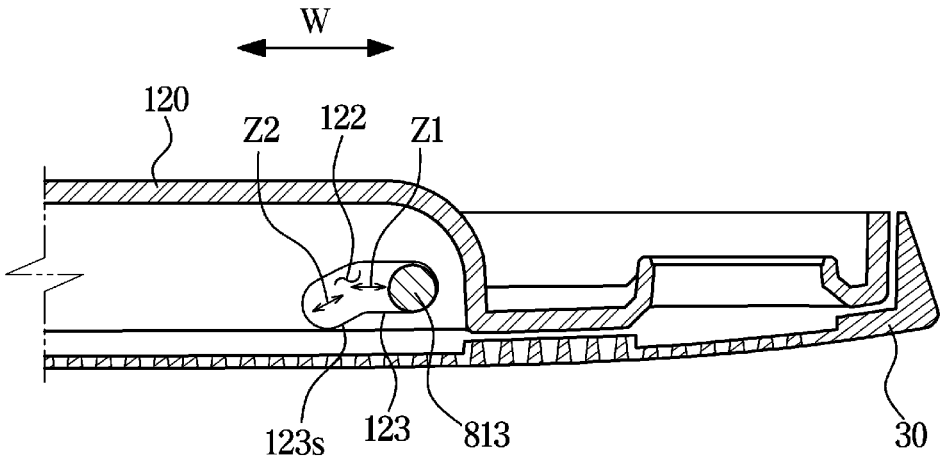
FIG. 19 is a cross-sectional view of an air purifier along A-A, according to another embodiment of the disclosure.

FIG. 19 is a cross-sectional view of an air purifier along A-A, according to another embodiment of the disclosure. Overlapping descriptions of the air purifier 1 according to the previous embodiment of the disclosure will not be repeated herein, and only differing features will now be described.

The edge plate 120 of the housing 100 may further include the settling groove 122 to which the shaft projection 813 is inserted for the discharge assembly 800 to be rotatable against the housing 100. The settling groove 122 may be formed on one side of the edge plate 120 that matches the shaft projection 813.

The settling groove 122 may include the guide plane 123 for the shaft projection 813 to rotate or slide thereon. The guide plane 123 may extend in the direction Z1 in parallel with the edge extension direction W of the edge plate 120 on which the settling groove 122 is formed. The extension length of the guide plane 123 may be longer than a diameter of the shaft projection 813.

The guide plane 123 may further include a slope 123*s* tilted toward the lower side of the air purifier 1.

The shaft projection 813 may slide along the guide plane in the direction Z1 in parallel with the edge extension direction W of the edge plate 120 on which the settling groove 122 is formed. When reaching the slope 123*s*, the shaft projection 813 may move a little to the lower side of the air purifier 1 along the slope 123*s* in the direction Z2. The shaft projection 813 is caught by the lower end of the slope 123*s* while the edge plate 120 is fully opened, and prevented from arbitrarily moving along the settling groove 122 during a procedure of fixing the convergent space 300 or the electric room 700 arranged in the convergent space 300, thereby increasing work efficiency.

Figure 20:
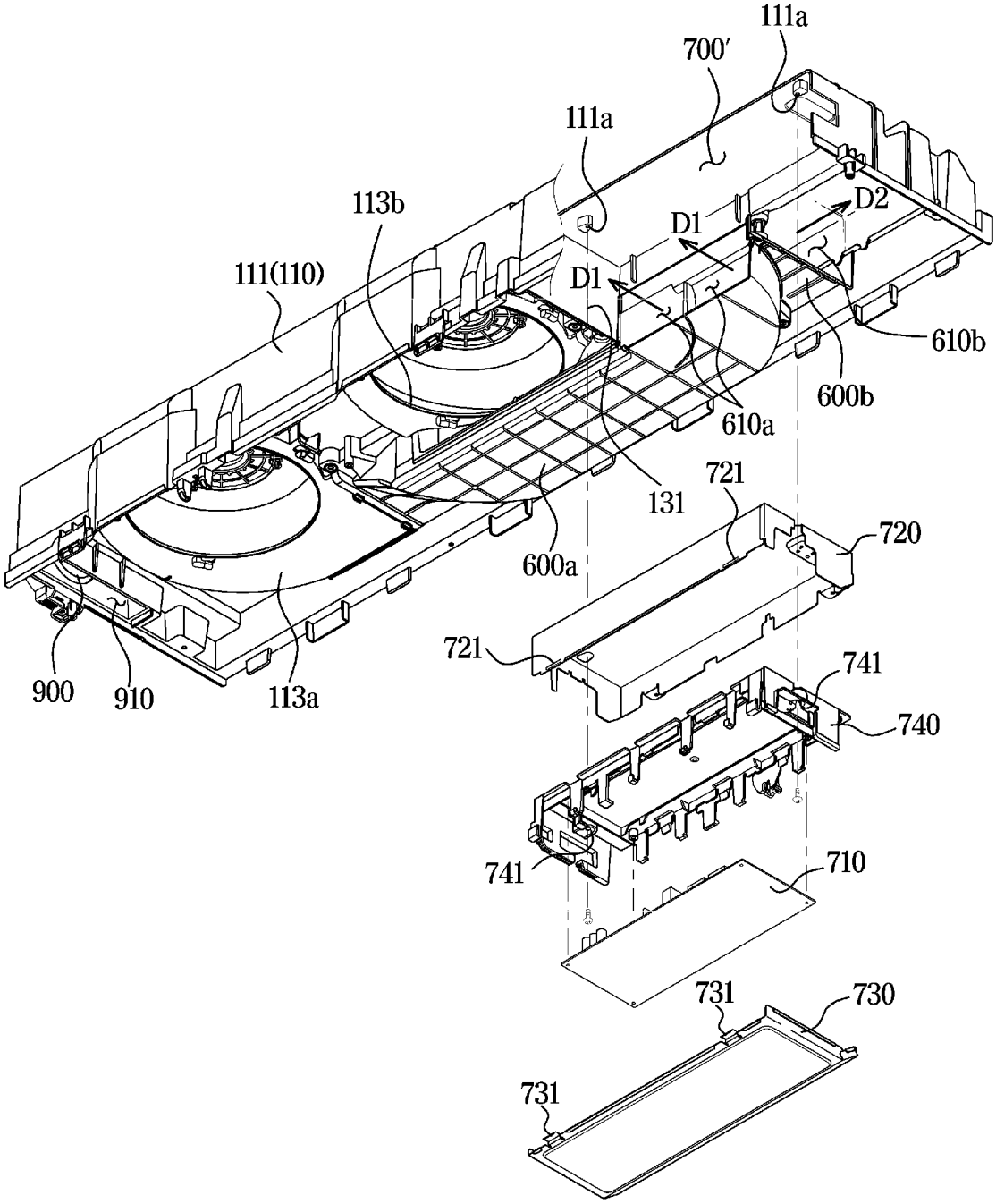
FIG. 20 is an exploded perspective view of an electric room, according to an embodiment of the disclosure.

FIG. 20 is an exploded perspective view of an electric room, according to an embodiment.

A structure in which the electric room 700 is fixed into the convergent space 300 will now be described in detail.

The air purifier 1 may include the electric room 700 including the electric components 710 for driving and controlling components of the air purifier 1.

The electric room 700 may include the electric room box 720, a substrate fixer 740, the electric components 710 and the electric room cover 730. The electric room box 720, the substrate fixer 740, the electric components 710 and the electric room cover 730 may be coupled in the vertical direction in the stated order.

The electric room box 720 may be shaped substantially like a rectangular parallelepiped with the open bottom. The electric room box 730 may include the electric components 710 and the substrate fixer 740 to fix the electric components 710. Alternatively, the electric room box 720 may be integrally formed with the substrate fixer 740 to fix the electric components 710.

The electric room cover 730 may cover the open bottom of the electric room box 720 and may be fixed to the electric room box 720. The electric room cover 730 may be coupled with the electric room box 720 when hooks 731 formed at edges of the electric room cover 730 and hook grooves 721 formed on the electric room box 720 are coupled with each other.

Referring to FIG. 20, the electric room 700 may be arranged in the convergent space 300. Specifically, the electric room 700 may be fixed to the top of the housing 100 to be arranged in the convergent space 300. The electric room 700 may be fixed in the electric room placement area 700' located in the upper portion of the housing. The electric room 700 may be fixed to the top of one side of the first body housing 111 corresponding to the convergent space 300.

Fasteners 111*a* protruding toward the convergent space 300 from the ceiling of the first body housing 111 may be formed in the electric room placement area 700' of the body housing, the first body housing 111 in particular.

Fixers 741 formed to match the fasteners 111*a* may be arranged on the substrate fixer 740. When the fasteners 111*a* and the fixers 741 are coupled together after the substrate fixer 740 is settled in the electric room box 720, the substrate fixer 740 may pressurize and fix the electric room box 720 to the first body housing 111. Alternatively, when the electric room box 720 is integrally formed with the substrate fixer 740, the fixers 741 formed to match the fasteners 111*a* may be arranged on the electric room box 720.

Although FIG. 20 shows the fasteners 111*a* and the fixers 741 being coupled by fastening members, the fasteners 111*a* and the fixers 741 may be provided in a structure of hooks and hook grooves to be coupled to each other.

When the electric room 700 is fixed to the top of the housing 100 to be arranged in the convergent space 300, the first flow path outlet 610*a* formed at one end of the first flow path 600*a* as shown in FIG. 16 may be arranged under the electric room 700. The second flow path outlet 610*b* formed at one end of the second flow path may be arranged on the circumference of the electric room 700.

Several embodiments of the disclosure have been described above, but those of ordinary skill in the art will understand and appreciate that various modifications can be made without departing from the scope of the disclosure. Thus, it will be apparent to those of ordinary skill in the art that the true scope of technical protection is only defined by the following claims.

What is claimed is:

1. A ceiling type air purifier comprising:

a housing having an opening on a lower side;

a filter arranged on one side of the opening and fixed to the housing;

a fan configured to circulate air having passed through the filter;

a convergent space formed in the housing and configured to receive air circulated by the fan; and a discharge assembly including:

a discharge plate formed to match a lower portion of the convergent space, a discharge blade arranged in an opening formed in the discharge plate, and rotatably coupled with the discharge plate, so as to be rotatable relative to the discharge plate to control a moving direction of air discharged from the convergent space, and a rotation shaft arranged at one end of the discharge assembly;

wherein the discharge assembly is coupled with the housing to be rotatable on the rotation shaft so as to rotate to open the convergent space to allow access to the convergent space, and to rotate to close the convergent space.

2. The ceiling type air purifier of claim 1, further comprising:

an electric room arranged in the convergent space, and a plurality of electric components arranged in the electric room and configured to operate the ceiling type air purifier.

3. The ceiling type air purifier of claim 2, further comprising:

an installation area for the filter; and a partition plate formed in the housing and separating the installation area and the fan from the convergent space.

4. The ceiling type air purifier of claim 3, further comprising:

a flow path formed in the housing, wherein the flow path is configured so that the air circulated by the fan flows in the flow path from the fan, through the partition plate, and to the convergent space.

5. The ceiling type air purifier of claim 4, wherein the flow path includes:

a flow path outlet configured to discharge the air flowing in the flow path to the convergent space, wherein the flow path outlet is arranged on at least one of a lower side and circumference of the electric room.

6. The ceiling type air purifier of claim 5, wherein the discharge assembly is arranged under the flow path outlet.

7. The ceiling type air purifier of claim 6, wherein the discharge assembly further includes:

a blade motor adjacent to the rotation shaft and fixed to the discharge plate, and configured to rotate the discharge blade.

8. The ceiling type air purifier of claim 7, wherein the discharge plate includes:

a shaft projection arranged on the rotation shaft and formed on one side of the discharge plate, and the housing includes:

a settling groove in which the shaft projection is inserted so that the discharge assembly is rotatable.

9. The ceiling type air purifier of claim 8, wherein the housing includes:

a body housing including the flow path and the partition plate; and an edge plate matching edges of a lower side of the body housing formed along the opening of the housing, wherein the settling groove is formed on one side of the edge plate.

10. The ceiling type air purifier of claim 9, wherein the settling groove includes a guide plane on which the shaft projection is rotatable and slidable.

11. The ceiling type air purifier of claim 10, wherein the guide plane is formed in a longitudinal direction of the edge plate on which the settling groove formed.

12. The ceiling type air purifier of claim 11, wherein the guide plane includes a slope tilted toward a lower side of the ceiling type air purifier.

13. The ceiling type air purifier of claim 7, wherein the discharge plate includes:

a buffer including a curved plane on a top of a side of the discharge plate opposite to the blade motor.

14. The ceiling type air purifier of claim 1, further comprising:

a grill covering the filter and the discharge assembly, the grill being detachably coupled with the lower side of the housing.

15. The ceiling type air purifier of claim 14, wherein the grill includes a plurality of holes formed on the grill, and the discharge assembly further includes:

a display configured to display an operation status of the ceiling type air purifier through the plurality of holes formed on the grill.

16. A ceiling type air purifier comprising:

a housing having an opening on a lower side;

a filter arranged on one side of the opening and fixed to the housing;

a fan configured to circulate air having passed through the filter;

a convergent space formed in the housing and configured to receive air circulated by the fan;

a discharge assembly including:

a discharge plate formed to match a lower portion of the convergent space, a discharge blade rotatably coupled with the discharge plate, so as to be rotatable to control a moving direction of air discharged from the convergent space, and a rotation shaft arranged at one end of the discharge assembly;

wherein the discharge assembly is coupled with the housing to be rotatable on the rotation shaft so as to rotate to open the convergent space to allow access to the convergent space, and to rotate to close the convergent space;

an installation area for the filter;

a partition plate formed in the housing and separating the installation area and the fan from the convergent space; and a flow path formed in the housing, wherein the flow path is configured so that the air circulated by the fan flows in the flow path from the fan, through the partition plate, and to the convergent space.

17. A ceiling type air purifier comprising:

a housing having an opening on a lower side;

a filter arranged on one side of the opening and fixed to the housing;

a fan configured to circulate air having passed through the filter;

a convergent space formed in the housing and configured to receive air circulated by the fan;

a discharge assembly including:

a discharge plate formed to match a lower portion of the convergent space, a discharge blade rotatably coupled with the discharge plate so as to be rotatable to control a moving direction of air discharged from the convergent space, and a rotation shaft arranged at one end of the discharge assembly;

wherein the discharge assembly is coupled with the housing to be rotatable on the rotation shaft so as to rotate to open the convergent space to allow access to the convergent space, and to rotate to close the convergent space; and a grill covering the filter and the discharge assembly, the grill being detachably coupled with the lower side of the housing, the grill including a plurality of holes formed on the grill, wherein the discharge assembly further includes a display configured to display an operation status of the ceiling type air purifier through the plurality of holes formed on the grill.

* * * * *